US008820284B2

(12) United States Patent
Mori et al.

(10) Patent No.: US 8,820,284 B2
(45) Date of Patent: Sep. 2, 2014

(54) VARIABLE VALVE GEAR FOR INTERNAL COMBUSTION ENGINE

(71) Applicant: Honda Motor Co. Ltd., Tokyo (JP)

(72) Inventors: Hidemichi Mori, Wako (JP); Dai Kataoka, Wako (JP); Nozomi Okada, Wako (JP); Makoto Fujikubo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/847,380

(22) Filed: Mar. 19, 2013

(65) Prior Publication Data

US 2013/0255611 A1 Oct. 3, 2013

(30) Foreign Application Priority Data

Mar. 30, 2012 (JP) ..... 2012-079013

(51) Int. Cl.
*F01L 1/18* (2006.01)

(52) U.S. Cl.
USPC ..... 123/90.39; 123/90.16; 123/90.44; 123/90.61; 74/559; 74/569

(58) Field of Classification Search
USPC ..... 123/90.16, 90.39, 90.44, 90.61; 74/559, 74/569
See application file for complete search history.

(56) References Cited

U.S. PATENT DOCUMENTS 7,997,244 B2 * 8/2011 Ito et al. ..... 123/90.33

FOREIGN PATENT DOCUMENTS

JP 2002-122007 A 4/2002
JP 2011-202625 A 10/2011

* cited by examiner

*Primary Examiner* — Ching Chang
(74) *Attorney, Agent, or Firm* — Birch, Stewart, Kolasch & Birch, LLP

(57) ABSTRACT

A variable valve gear for an internal combustion engine that is capable of being disposed in a small compact manner and also capable of reducing the generation of a knocking sound. In a variable valve gear, a camshaft is supported by supporting walls of a cylinder head, and camshaft holders formed separately from the supporting walls, two exhaust rocker arms are disposed adjacent to each other, and a connecting pin is movably inserted into pin holes provided in the exhaust rocker arms by an actuator through a pushrod to connect or disconnect the exhaust rocker arms to or from each other. In the variable valve gear, the pushrod is slidably supported in a rod insertion hole of the camshaft holder with the connecting pin being disposed between the pair of camshaft holders and has an axis that is offset toward the camshaft with respect to an axis of the pushrod.

20 Claims, 14 Drawing Sheets

VARIABLE VALVE GEAR FOR INTERNAL COMBUSTION ENGINE

CROSS-REFERENCE TO RELATED APPLICATIONS

The present application claims priority under 35 USC 119 to Japanese Patent Application No. 2012-079013 filed Mar. 30, 2012 the entire contents of which are hereby incorporated by reference.

BACKGROUND OF THE INVENTION

1. Field of the Invention

The present invention relates to a variable valve gear for an internal combustion engine wherein a connecting pin is moved to connect or disconnect two rocker arms to or from each other, thereby causing both arms to swing integrally or causing one of the rocker arms to swing and the other rocker aim to stop.

2. Description of Background Art

Valve gears for internal combustion engines are known. See, for example, JP-A No. 2011-202625 wherein two intake-side rocker arms are configured to be connectable to each other by means of a connecting pin that is movable back and forth by an actuator. In addition, see, for example, JP-A No. 2002-122007 wherein an intake valve is directly opened and closed by a camshaft and an exhaust valve is opened and closed by a rocker arm that is driven by the camshaft.

In JP-A No. 2011-202625, the connecting pin inserted into the two intake-side rocker arms is provided at an upper portion of the rocker arms. For this reason, the intake-side rocker arms protrudes upwardly and an upper end of the valve gear is raised, leading to increases in the total height and size of the internal combustion engine.

Even in the case where the variable valve gear including the rocker arm stopping mechanism as disclosed in the above-described JP-A No. 2011-202625 is employed in the valve gear, such as disclosed in the JP-A No. 2002-122007, wherein the intake valve is directly driven by the single camshaft and the exhaust valve is driven through the rocker arm, there is a need for a small compact layout using a limited amount of space in a cylinder head.

Furthermore, in JP-A No. 2011-202625, when a pushrod of the actuator is moved back for releasing the connection between the two intake-side rocker arms, the connecting pin returns quickly under the elastic force of a spring, which might create a knocking sound.

SUMMARY AND OBJECTS OF THE INVENTION

Accordingly, an embodiment of the present invention has been made in view of the foregoing wherein a variable valve gear for an internal combustion engine is capable of being disposed in a small compact manner and is also capable of reducing the generation of a knocking sound.

In order to address the above-mentioned problem, according to an embodiment of the present invention, there is provided a variable valve gear for an internal combustion engine in which a camshaft (31, 131, 231, 331) that is rotatably supported by a pair of cam supporting portions (26*c*) provided in a cylinder head (21, 130, 140, 150). A pair of camshaft holders (32) are separated from the cam supporting portions (26*c*) with two exhaust rocker arms (38 and 71, or 138 and 171) being driven by the camshaft (31, 131, 231, 331) that are swingably supported by a rocker shaft (72) mounted in the pair of cam supporting portions (26*c*), and disposed adjacent to each other. A connecting pin (74, 193) is movable inserted into pin holes (115*e* and 116*e*) provided in the exhaust rocker arms (38 and 71, or 138 and 171) by an actuator (87) through a pushrod (91) to connect or disconnect the two rocker arms (38 and 71, or 138 and 171) to or from each other. In the variable valve gear, the pushrod (91) is slidably supported in a through-hole (32*b*) provided in the camshaft holder (32). The connecting pin (74, 193) is disposed between the pair of camshaft holders (32), and the connecting pin (74, 193) has an axis (74*e*, 193*e*) that is offset toward the camshaft (31, 131, 231, 331) with respect to an axis (91*d*) of the pushrod (91).

With this construction, the connecting pin and the pushrod can be disposed in a concentrated manner close to the camshaft. Thus, the variable valve gear can be disposed in a small compact manner. Furthermore, the axis of the connecting pin is offset from the axis of the pushrod. Thus, with the connecting pin axially pressed by the actuator through the pushrod, a moment can be produced on the pushrod. This moment can prevent the quick return of the pushrod when the connection between the two exhaust rocker arms is released for reducing the generation of knocking sounds.

In the above-described construction, the arrangement may be such that the connecting pin (74, 193) is disposed close to the rocker shaft (72) that swingably supports the exhaust rocker arms (38 and 71, or 138 and 171). With this arrangement, since the connecting pin is disposed close to the rocker shaft, the deviations in a turning direction between the pin holes of the two exhaust rocker arms and in a direction perpendicular to the axis between the connecting pin and the pushrod can be further reduced, thereby allowing easy insertion of the connecting pin into the pin hole and a reduction of the wearing of the sliding portion between the connecting pin and the pushrod.

Furthermore, in the above-described construction, the arrangement may be such that the exhaust rocker arms (38 and 71, or 138 and 171) taken as a pair are disposed one on each side of a spark plug (123) with a support boss (26*e*), formed integral with a cylinder head body (26), being disposed below and between the exhaust rocker arms (38 and 71, or 138 and 171) for supporting the rocker shaft (72). The connecting pin (74) is disposed above the support boss (26*e*). With this arrangement, the rocker shaft is supported by the support boss in addition to the pair of cam supporting portions. Therefore, the stiffness of the rocker shaft can be ensured. Also, the support boss is disposed by effectively using the space between the pair of cam supporting portions. Therefore the variable valve gear can be made compact.

Moreover, in the above-described construction, the arrangement may be such that the pushrod (91) is composed of a rod portion (91*a*) and a pressing portion (91*b*) having a diameter larger than the rod portion (91*a*) with the pressing portion (91*b*) being provided at an end of the rod portion (91*a*) for abutment against an end surface of the connecting pin (74). The rod portion (91*a*) is disposed inside the through-hole (32*b*) provided toward the spark plug (123) with respect to bolts (46) that fasten the camshaft holder (32) to the cam supporting portion (26*c*). With this arrangement, it is possible to compactly dispose the variable valve gear while avoiding the bolts that fasten the cam supporting portions and the camshaft holder together.

Also, in the above-described construction, the arrangement may be such that the camshaft holder (32) is formed with a protruding portion (32*a*) that protrudes toward the spark plug (123) with the protruding portion (32*a*) being formed with the through-hole (32*b*). With this arrangement, it is possible to support the pushrod while reducing the whole size of the camshaft holder for reductions in size and weight.

In addition, in the above-described construction, the arrangement may be such that the pair of exhaust rocker arms is composed of a drive-side rocker arm (38) that is provided close to the pushrod (91) and constantly driven by the camshaft (31) during operation of the internal combustion engine (10), and an inactive rocker arm (71) that is provided on a side of the drive-side rocker arm (38) opposite the pushrod (91) and becomes inactive when disconnected from the drive-side rocker arm (38). The camshaft (31) is formed with an exhaust cam (31*b*) for driving the drive-side rocker arm (38) and an axially extending hole (31*e*) that extends axially of the camshaft (31). A shaft (81) included in a decompression mechanism (48) is turnably inserted into the axially extending hole (31*e*) with the shaft (81) being provided at a tip thereof with a protrusion (82*a*) that can protrude radially outwardly from a base circle portion (31*m*) provided on the exhaust cam (31*b*). With this arrangement, the structure, in which the shaft of the decompression mechanism is turnably disposed inside the axially extending hole formed axially of the camshaft, allows a compact layout of the decompression mechanism and miniaturization of the internal combustion engine.

In addition, in the above-described construction, the arrangement may be such that the pair of exhaust rocker arms is composed of a drive-side rocker arm (138) that is provided away from the pushrod (91) and constantly driven by the camshaft (331) during operation of the internal combustion engine (10), and an inactive rocker arm (171) that is provided closer to the pushrod (91) than the drive-side rocker arm (138) and becomes inactive when disconnected from the drive-side rocker arm (138). The inactive rocker arm (171) is formed with a claw portion (71*a*) that slides with a base circle (31*d*) of the camshaft (331). The camshaft (331) is formed with an axially extending hole (31*e*) that extends axially of the camshaft (331). The shaft (81) included in a decompression mechanism (48) is turnably inserted into the axially extending hole (31*e*) with the shaft (81) being provided at the tip thereof with a protrusion (82*a*) that can protrude radially outwardly from the base circle (31*d*). With this arrangement, the structure, wherein the shaft of the decompression mechanism is turnably inserted into the axially extending hole formed axially of the camshaft, allows a compact layout of the decompression mechanism and miniaturization of the internal combustion engine.

In addition, in the above-described construction, the arrangement may be such that an intake valve (34) is opened and closed by the camshaft (31) through a valve lifter (33) with an exhaust valve (39, 39) that is opened and closed by the camshaft (31, 131, 231, 331) through the exhaust rocker arms (38 and 71, or 138 and 171). With this arrangement, since the intake and exhaust valves are opened and closed by the single camshaft, the cylinder head can be reduced in weight and size, as compared with a structure in which the intake and exhaust valves are opened and closed by two respective camshafts.

Further, in the above-described construction, the arrangement may be such that the bolts (46) are disposed at each end of the camshaft (31, 131, 231, 331) with the connecting pin (74, 193) being disposed between the pair of bolts (46) and the connecting pin (74, 193) being disposed between the camshaft (31, 131, 231, 331) and the spark plug (123). With this arrangement, the connecting pin, and consequently, the variable valve gear, can be disposed in a small compact manner.

According to an embodiment of the present invention, the pushrod is slidably supported in the through-hole provided in the camshaft holder. The connecting pin is disposed between the pair of camshaft holders. The axis of the connecting pin is offset toward the camshaft with respect to the axis of the pushrod. Thus, the connecting pin and the pushrod can be disposed in a concentrated manner close to the camshaft, and thus the variable valve gear can be disposed in a small compact manner. Furthermore, the axis of the connecting pin is offset from the axis of the pushrod. Thus, with the connecting pin axially pressed by the actuator through the pushrod, a moment can be produced on the pushrod. This moment can prevent the quick return of the pushrod when the connection between the two exhaust rocker arms is released for reduce the generation of knocking sounds.

Also, the connecting pin is disposed close to the rocker shaft that swingably supports the exhaust rocker arms. Thus, the deviations in a turning direction between the pin holes of the two exhaust rocker arms and in a direction perpendicular to the axis between the connecting pin and the pushrod can be further reduced, thereby allowing easy insertion of the connecting pin into the pin hole and a reduction of the wearing of the sliding portion between the connecting pin and the pushrod.

Furthermore, the exhaust rocker aims taken as a pair are disposed one on each side of the spark plug. The support boss formed integral with the cylinder head body is disposed below between the exhaust rocker arms for supporting the rocker shaft. The connecting pin is disposed above the support boss. Thus, the rocker shaft is supported by the support boss in addition to the pair of cam supporting portions. Therefore the stiffness of the rocker shaft can be ensured. Also, the support boss is disposed by effectively using the space between the pair of cam supporting portions. Therefore the variable valve gear can be made compact.

Moreover, the pushrod is composed of the rod portion, and the pressing portion that has a diameter larger than the rod portion and is provided at an end of the rod portion for abutment against an end surface of the connecting pin. The rod portion is inserted into the through-hole provided toward the spark plug with respect to the bolts that fasten the camshaft holder to the cam supporting portion. Thus, it is possible to compactly dispose the variable valve gear while avoiding the bolts that fasten the cam supporting portions and the camshaft holder together.

Also, the camshaft holder is formed with the protruding portion that protrudes toward the spark plug. The protruding portion is formed with the through-hole. Thus, it is possible to support the pushrod while reducing the whole size of the camshaft holder for reductions in size and weight.

In addition, the pair of exhaust rocker arms is composed of the drive-side rocker arm that is provided close to the pushrod and constantly driven by the camshaft during operation of the internal combustion engine. The inactive rocker arm is provided on the side of the drive-side rocker arm opposite the pushrod and becomes inactive when disconnected from the drive-side rocker arm. The camshaft is formed with the exhaust cam for driving the drive-side rocker arm and the axially extending hole that extends axially of the camshaft. The shaft included in the decompression mechanism is turnably inserted into the axially extending hole. The shaft is provided at a tip thereof with the protrusion that can protrude radially outwardly from the base circle portion provided on the exhaust cam. Thus, the structure, in which the shaft of the decompression mechanism is turnably inserted into the axially extending hole formed axially of the camshaft, allows a compact layout of the decompression mechanism and miniaturization of the internal combustion engine.

In addition, the pair of exhaust rocker arms is composed of the drive-side rocker arm that is provided away from the pushrod and constantly driven by the camshaft during operation of the internal combustion engine; and the inactive rocker arm that is provided closer to the pushrod than the drive-side rocker arm and becomes inactive when disconnected from the drive-side rocker arm. The inactive rocker arm is formed with the claw portion that slides with the base circle of the camshaft. The camshaft is formed with the axially extending hole that extends axially of the camshaft. The shaft included in the decompression mechanism is turnably inserted into the axially extending hole. The shaft is provided at a tip thereof with the protrusion that can protrude radially outwardly from the base circle. Thus, the structure, in which the shaft of the decompression mechanism is turnably inserted into the axially extending hole formed axially of the camshaft, allows a compact layout of the decompression mechanism and miniaturization of the internal combustion engine.

Further, the intake valve is opened and closed by the camshaft through the valve lifter, and the exhaust valve is opened and closed by the camshaft through the exhaust rocker arms. With the structure in which the intake and exhaust valves are opened and closed by the single camshaft, the cylinder head can be reduced in weight and size, as compared with a structure in which intake and exhaust valves are opened and closed by two respective camshafts.

Further, the bolts are disposed at each end of the camshaft. The connecting pin is disposed between the pair of bolts. Also, the connecting pin is disposed between the camshaft and the spark plug. Thus, the connecting pin, and consequently, the variable valve gear, can be disposed in a small compact manner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment of the present invention will be described with reference to the accompanying drawings.

Figure 1:
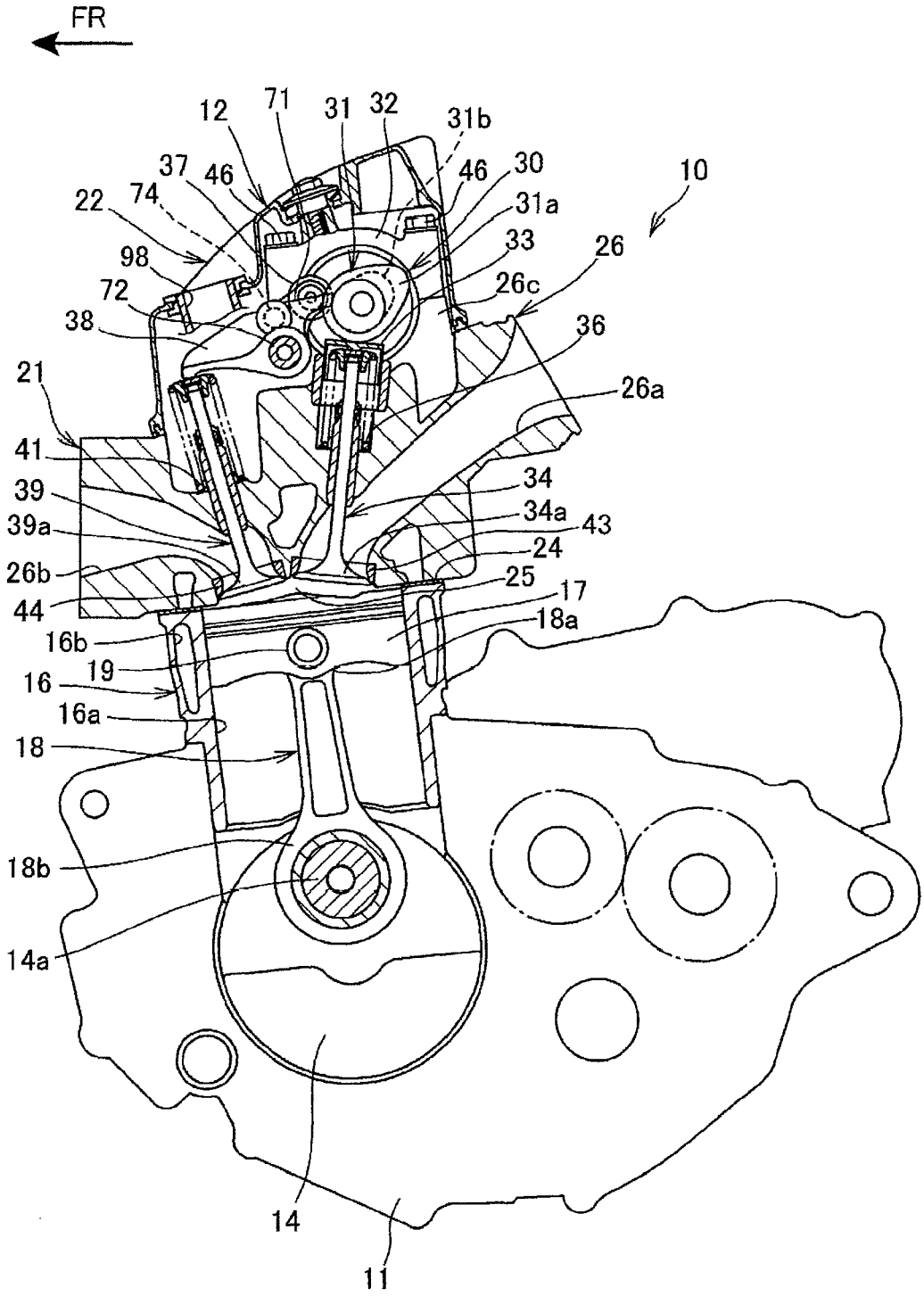
FIG. 1 is a sectional view of an internal combustion engine in accordance with a first embodiment of the present invention.

FIG. 1 is a sectional view of an internal combustion engine 10 in accordance with the present invention.

The internal combustion engine 10 is a single-cylinder four-valve engine (having two intake valves and two exhaust valves) that includes a crankcase 11 for integrally housing a transmission, and a cylinder portion 12 provided at an upper portion of the crankcase 11. It is to be noted that, for the sake of convenience, the side of the crankcase 11 on which the cylinder portion 12 is provided (left side in FIG. 1) is defined as a front portion of the internal combustion engine 10, and the front of the internal combustion engine 10 is indicated by arrow FR (the same shall apply hereinafter).

The crankcase 11 is composed of a pair of two cases separated from each other in the direction of the frontside and backside of the drawing sheet. A crankshaft 14 is turnably supported in these cases through a bearing. The crankshaft 14 has a length extending in the direction of the frontside and backside of the drawing sheet.

The cylinder portion 12 is composed of a cylinder block 16 that is mounted to an upper portion of the crankcase 11 with a piston 17 that is movably inserted into a cylinder hole 16*a* formed in the cylinder block 16. A connecting rod 18 includes a small end 18*a* connected to the piston 17 through a piston pin 19 and a large end 18*b* connected to a crankpin 14*a* of the crankshaft 14. A cylinder head 21 is mounted to an upper end of the cylinder block 16 with a head cover 22 for closing an upper end opening of the cylinder head 21.

The cylinder block 16 is formed at an upper portion thereof with a water jacket 16*b* for cooling, the water jacket 16*b* surrounding the cylinder hole 16*a*. The cylinder head 21 is mounted to the cylinder block 16 through a head gasket 24. A combustion chamber 25 is formed by a top surface of the piston 17, an inner peripheral surface of the cylinder hole 16*a*, and a lower surface of the cylinder head 21.

The cylinder head 21 is composed of an aluminum alloy die-cast cylinder head body 26 and a variable valve gear 30 that is assembled in the cylinder head body 26 and the head cover 22.

The cylinder head body 26 includes an intake port 26*a* that opens into the combustion chamber 25 for introducing an air-fuel mixture into the combustion chamber 25 with an exhaust port 26*b* that opens into the combustion chamber 25 for discharging exhaust gas therefrom. Supporting walls 26*c* are formed in an upwardly-protruding manner for supporting a camshaft 31 to be described in detail later.

The variable valve gear 30 includes the camshaft 31 that is held by the pair of supporting walls 26*c* (only one reference sign 26*c* is shown) of the cylinder head body 26 and a pair of camshaft holders 32 (only one reference sign 32 is shown) and is rotatably mounted. An intake valve 34 is driven by an intake cam 31*a* of the camshaft 31 through a valve lifter 33 to open and close the combustion-chamber-side opening of the intake port 26*a* with a valve spring 36 for urging the intake valve 34 in a direction to close the intake valve 34. A first rocker arm 38 is provided with a roller 37 for swinging with the roller 37 following an exhaust cam 31*b* of the camshaft 31. An exhaust valve 39 is driven by the first rocker arm 38 to open and close the combustion-chamber-side opening of the exhaust port 26*b* with a valve spring 41 that urges the exhaust valve 39 in a direction to close the exhaust valve 39. A second rocker arm 71 (to be described in detail later) is connected or disconnected to or from the first rocker arm 38 and thus can swing or stop. An intake valve seat 43 is mounted to the combustion-chamber-side opening of the intake port 26*a* and formed with a seating surface of an umbrella portion 34*a* of the intake valve 34. An exhaust valve seat 44 is mounted to the combustion-chamber-side opening of the exhaust port 26*b* and formed with a seating surface of an umbrella portion 39*a* of the exhaust valve 39.

The head cover 22 covers the cylinder head body 26 and the variable valve gear 30 from above. In an upper portion of the head cover 22, toward the front, there is provided an upper end opening of a cap guiding member 98 that guides the insertion of a spark plug cap.

Figure 2:
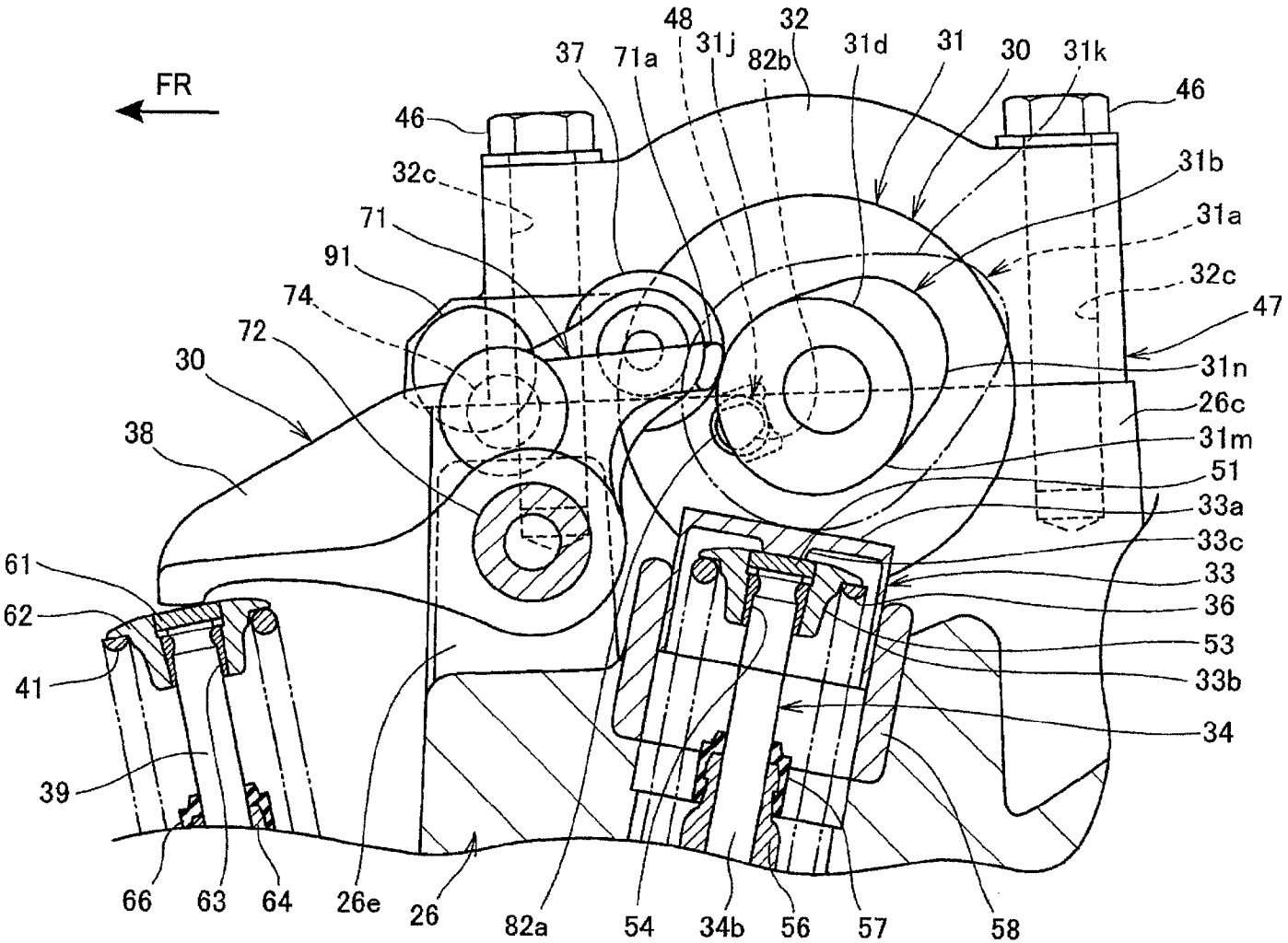
FIG. 2 is a sectional view of essential parts of a variable valve gear.

FIG. 2 is a sectional view of the essential parts of the variable valve gear 30.

The camshaft holders 32 are mounted, by two bolts 46 for each one, to the pair of supporting walls 26*c* (only one reference sign 26*c* is shown) protruding integrally upwardly from the cylinder head body 26. The camshaft 31 is rotatably supported by the supporting walls 26*c* and the camshaft holders 32. The supporting wall 26*c* and the camshaft holder 32 constitute a camshaft supporting portion 47.

A decompression mechanism 48 is attached to the camshaft 31. The decompression mechanism 48 opens the exhaust valve 39 at the time of internal combustion engine starting to reduce the pressure in a cylinder in a compression stroke, thereby reducing the force necessary for cranking and improving starting performance.

The valve lifter 33 is a bottomed cylindrical member composed of a bottom wall 33*a* that has an outer surface pressed by the intake cam 31*a* with a peripheral wall 33*b* that stands up from an outer peripheral edge of the bottom wall 33*a*. The bottom wall 33*a* is formed on an inner surface thereof with a protrusion 33*c*. An end of a shaft portion 34*b* of the intake valve 34 abuts against the protrusion 33*c* through a shim 51. A retainer 53 is fixed to the shaft portion 34*b* of the intake valve 34 through a cotter pin 54. The retainer 53 supports one end of the valve spring 36. A valve guide 56 and a stem seal 57 are provided. The peripheral wall 33*b* is movably fitted against an inner peripheral surface of a cylindrical member 58 that is provided in the cylinder head body 26. In the same manner as the intake valve 34, the exhaust valve 39 is provided with a shim 61, a retainer 62, a cotter pin 63, a valve guide 64, and a stem seal 66.

The internal combustion engine 10 is provided with the second rocker arm 71 that is adjacent to the first rocker arm 38 for driving the other exhaust valves (not shown). The first and second rocker arms 38 and 71 are swingably supported by a rocker shaft 72 that is fixed on the cylinder head body 26.

The camshaft 31 includes the intake cam 31*a* that drives the intake valve 34 with the exhaust cam 31*b* that drives one of the exhaust valves, i.e. the exhaust valve 39 through the first rocker arm 38. A base circle 31*d* is provided that slides with a leading end of the second rocker arm 71.

The intake cam 31*a* is composed of a base circle portion 31*j* formed in an arc shape with a cam lobe 31*k* formed continuous with the base circle portion 31*j* and raising radially outwardly from the base circle portion 31*j*. The exhaust cam 31*b* is composed of a base circle portion 31*m* formed in an arc shape with a cam lobe 31*n* formed continuous with the base circle portion 31*m* and raising radially outwardly from the base circle portion 31*m*.

The first rocker arm 38 includes the roller 37 at one end thereof. The roller 37 follows the exhaust cam 31*b* of the rotating camshaft 31 while rotating in contact therewith, thereby causing the first rocker arm 38 to swing. Furthermore, a connecting pin 74 for connecting the first rocker arm 38 to the second rocker arm 71 is inserted into an intermediate portion of the first rocker arm 38.

The second rocker arm 71 includes a claw portion 71*a* at one end thereof, the claw portion 71*a* is slidable with the base circle 31*d* of the camshaft 31.

Figure 3:
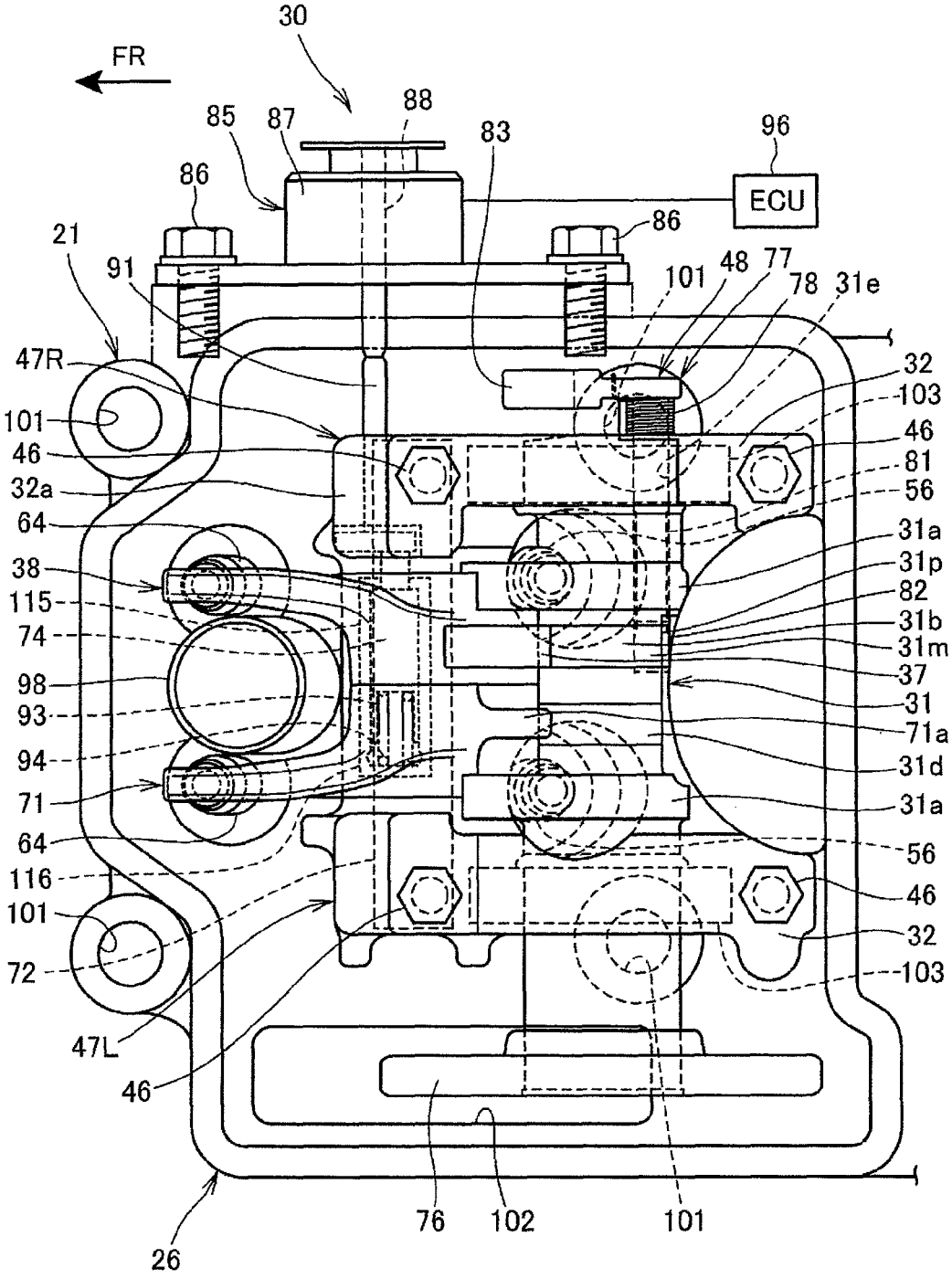
FIG. 3 is an explanatory diagram of a cylinder head.

FIG. 3 is an explanatory diagram of the cylinder head 21, viewed in the axial direction of the bolts 46.

For the discrimination between the pair of camshaft supporting portions 47 (see FIG. 2), the camshaft supporting portion located toward the second rocker arm 71 is denoted by 47L, and the camshaft supporting portion located toward the first rocker arm 38 is denoted by 47R.

The camshaft 31, between the pair of intake cams 31*a*, is formed with the exhaust cam 31*b* that slides with the roller 37 of the first rocker arm 38, and the base circle 31*d* that slides with the claw portion 71*a* of the second rocker arm 71. A cut-out portion 31*p* is provided in one circumferential portion of the base circle portion 31*m* of the exhaust cam 31*b*.

The camshaft 31 is rotatably supported in the pair of camshaft supporting portions 47L and 47R. The camshaft 31 is mounted at one end thereof with a cam sprocket 76 around which a timing chain (not shown) is wrapped, and at the other end of the camshaft 31, an axial hole 31*e* is formed along the axis of the camshaft 31. The decompression mechanism 48 is turnably provided in the axial hole 31*e*.

The decompression mechanism 48 includes a movable body 77 that is turnably mounted in the axial hole 31*e* of the camshaft 31 and turned by the centrifugal force caused by the rotation of the camshaft 31 with a torsion coil spring 78 that urges the movable body 77 in the opposite direction of turning by the centrifugal force.

The movable body 77 is composed of a shaft 81 turnably inserted into the axial hole 31*e* with a cam portion 82 provided at one end of the shaft 81 and a weight 83 provided at the other end of the shaft 81. The cam portion 82 is exposed to the outside from the cut-out portion 31*p* of the base circle portion 31*m* of the exhaust cam 31*b* formed on the camshaft 31.

Referring to FIG. 2, the cam portion 82 includes a protrusion 82*a* that protrudes radially outwardly from the base circle portion 31*m* of the exhaust cam 31*b*, and an arcuate portion 82*b* that forms a portion of the circle in cooperation with the base circle portion 31*m* when the cam portion 82 turns clockwise from the position shown in the drawing.

Referring to FIGS. 2 and 3, the rocker shaft 72 is supported by the pair of camshaft supporting portions 47L and 47R (more specifically, the pair of supporting walls 26*c*) and a support boss 26*e* that is located below the second rocker arm 71 and integrally formed in an upwardly-protruding manner on the cylinder head body 26.

Referring to FIG. 3, the variable valve gear 30 includes an exhaust-side stopping mechanism 85 that stops the operation of the second rocker arm 71 on the exhaust side and the exhaust valve 39 (see FIG. 2) opened and closed by the second rocker arm 71. The exhaust-side stopping mechanism 85 is composed of a solenoid actuator 87 that is mounted to a side surface of the head cover 22 (see FIG. 1) by a plurality of bolts 86 with a pushrod 91 that is movably supported by the camshaft supporting portion 47R (more specifically, the camshaft holder 32) for abutment against the tip of a plunger 88 included in the solenoid actuator 87. The connecting pin 74 is movably inserted into the first rocker arm 38 for abutment against the tip of the pushrod 91 with a pressing piece 93 that is adjacent to the connecting pin 74 and movably inserted into the second rocker arm 71. A compression coil spring 94 produces the force to press the pressing piece 93 against the connecting pin 74 with a cylinder body 115 that movably houses the connecting pin 74. A cylinder body 116 movably houses the pressing piece 93. An ECU (Engine Control Unit) 96 controls actuation of the solenoid actuator 87.

The cap guiding member 98 of cylindrical shape is provided between the first rocker arm 38 and the second rocker arm 71 for guiding a plug cap (not shown) connected to a spark plug (not shown). A bolt insertion hole 101 allows the insertion of a bolt that fastens the cylinder head 21 to the crankcase 11 (see FIG. 1) through the cylinder block 16 (see FIG. 1). A chain insertion hole 102 is provided in which the timing chain is disposed. A bearing 103 is provided in each of the camshaft supporting portions 47L and 47R for rotatably supporting the camshaft 31.

Figure 4:
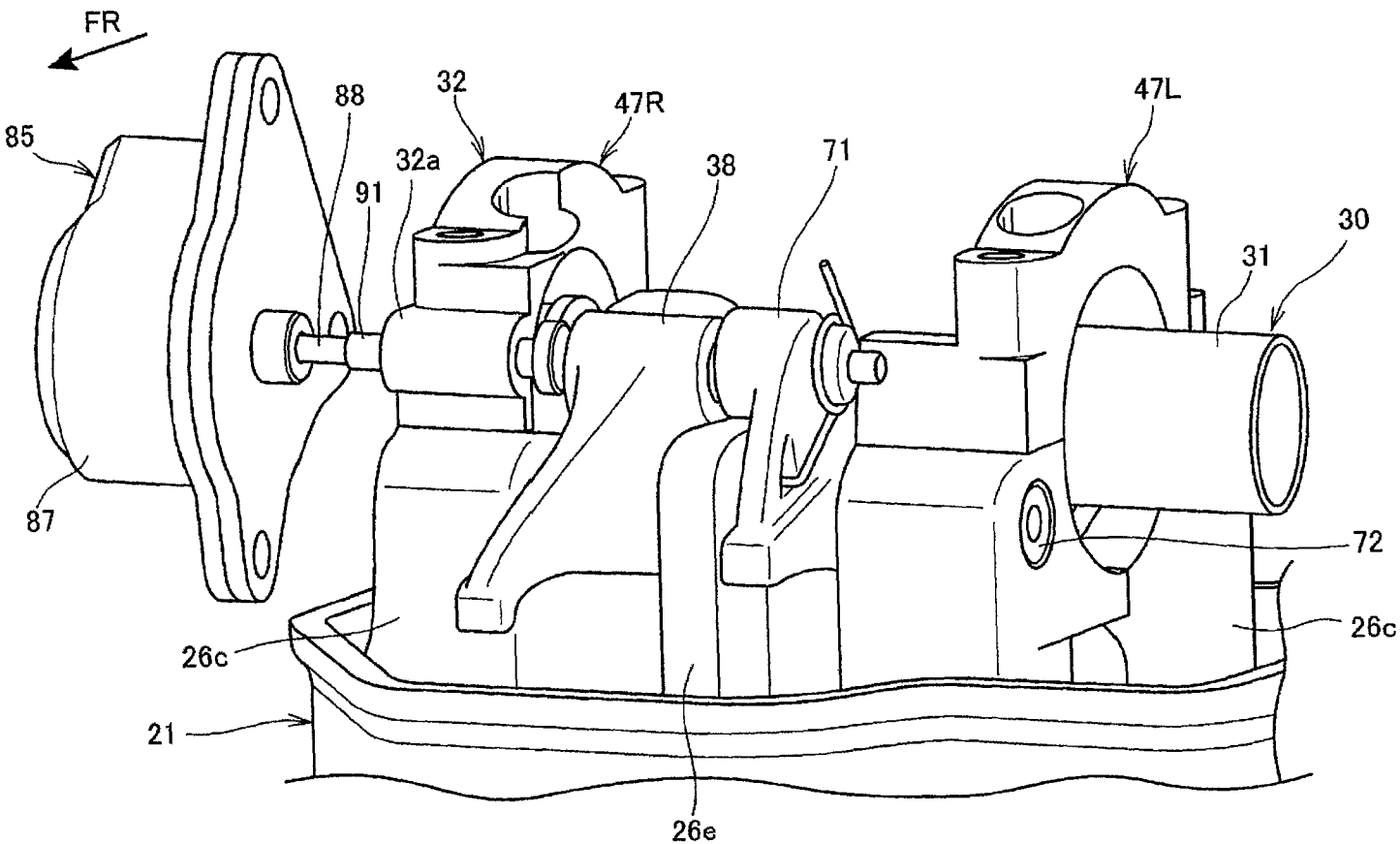
FIG. 4 is a perspective view of the variable valve gear provided in the cylinder head.

FIG. 4 is a perspective view of the variable valve gear 30 provided in the cylinder head 21.

The camshaft 31 is rotatably supported by the pair of camshaft supporting portions 47L and 47R. The rocker shaft 72 is supported by the pair of supporting walls 26*c* constituting the camshaft supporting portions 47L and 47R, and the support boss 26*e* disposed between the supporting walls 26*c*. The first rocker arm 38 and the second rocker arm 71 are turnably supported by the rocker shaft 72. The first rocker arm 38 is disposed between one of the supporting walls 26*c* and the support boss 26*e*. The second rocker arm 71 is disposed between the other of the supporting walls 26*c* and the support boss 26*e*.

A holder protruding portion 32*a* is integrally formed in a forwardly protruding manner on the camshaft holder 32 that constitutes one of the camshaft supporting portions, i.e. the camshaft supporting portion 47R. The pushrod 91, that constitutes the exhaust-side stopping mechanism 85, is movably mounted in the holder protruding portion 32*a*.

Figure 5:
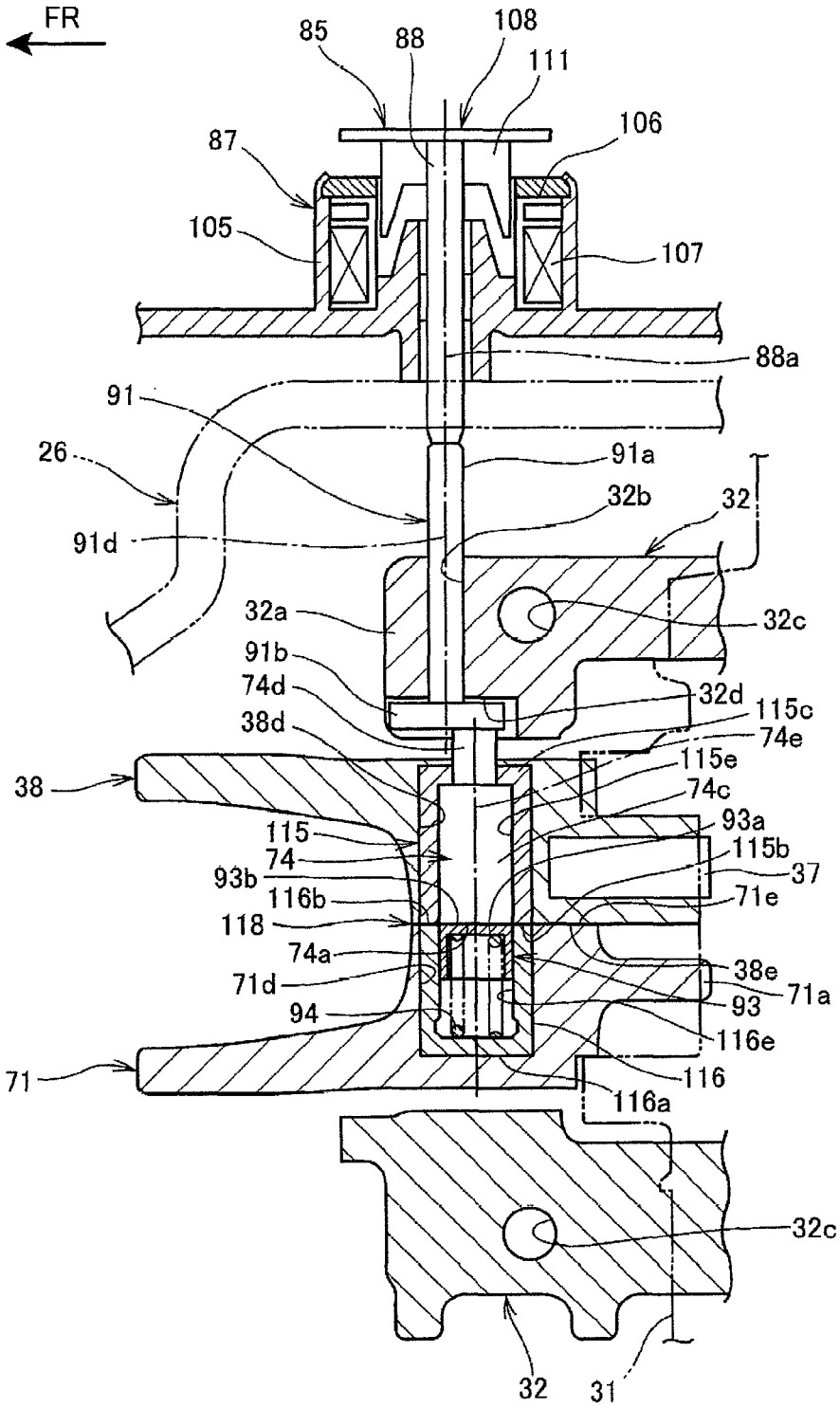
FIG. 5 is a sectional view of an exhaust-side stopping mechanism.

FIG. 5 is a sectional view of the exhaust-side stopping mechanism 85.

The solenoid actuator 87, that constitutes the exhaust-side stopping mechanism 85, is composed of a case 105 mounted to the head cover 22 (see FIG. 1); a core 106 provided within the case 105; a coil 107 wound around the core 106 and a movable body 108 movably provided in the case 105. The movable body 108 is composed of a movable iron core 111 movably disposed within the core 106 with the plunger 88 being mounted to the movable iron core 111. When the solenoid actuator 87 is turned on, thereby energizing the coil 107 and causing a magnetic field around the coil 107, the plunger 88 of the movable body 108 with the movable iron core 111 moves axially (toward the camshaft holder 32).

The pushrod 91 is a member that is movably inserted into a rod insertion hole 32*b* bored in the holder protruding portion 32*a* of the camshaft holder 32. The pushrod 91 is composed of a rod portion 91*a* formed in a straight line, and a pressing portion 91*b* having a diameter larger than the rod portion 91*a* and integrally provided at an end of the rod portion 91*a* for abutment against an end surface of the connecting pin 74. The rod insertion hole 32*b* is opened in a portion forward of a bolt insertion hole 32*c* for insertion of the bolt 46 (see FIG. 3). In addition, a holder recess 32*d* for receiving the pressing portion 91*b* of the pushrod 91 is formed in a side surface of the camshaft holder 32. The pushrod 91 has an axis 91*d*, the axis 91*d* being situated on the extended line of an axis 88*a* of the plunger 88.

The first rocker arm 38 has an arm hole portion 38*d* opened in a side surface thereof, and the cylinder body 115 of cylindrical shape is press-fitted in the arm hole portion 38*d*. The connecting pin 74 is movably inserted into a pin hole 115*e* provided in the cylinder body 115.

The connecting pin 74 is composed of a large diameter portion 74*c* inserted into the cylinder body 115, and a small diameter portion 74*d* integrally formed at an end portion of the large diameter portion 74*c*. The small diameter portion 74*d* passes through a bottom wall 115*c* of the cylinder body 115 and extends toward the pushrod 91. An axis 74*e* of the connecting pin 74 is offset toward the camshaft 31 (see FIG. 3) with respect to the axis 91*d* of the pushrod 91.

The second rocker arm 71 has an arm hole portion 71*d* opened in a side surface thereof, and the cylinder body 116 of cylindrical shape is press-fitted in the arm hole portion 71*d*. The pressing piece 93 of a U-shaped cross section is movably inserted into a pin hole 116*e* provided in the cylinder body 116. The compression coil spring 94 is provided between a bottom wall 93*a* of the pressing piece 93 and a bottom wall 116*a* of the cylinder body 116. The compression coil spring 94 is in position to press an end surface 93*b* of the pressing piece 93 with its elastic force against a leading end surface 74*a* of the connecting pin 74. Thus, the leading end surface 74*a* of the connecting pin 74 is flush with a mating face 118 between a side surface 38*e* of the first rocker arm 38 and a side surface 71*e* of the second rocker arm 71. In this state, end surfaces 115*b* and 116*b* of the cylinder bodies 115 and 116 are aligned with the above-described mating face 118, or provided inwardly of the arm hole portions 38*d* and 71*d*, respectively, from the mating face 118.

Figure 6:
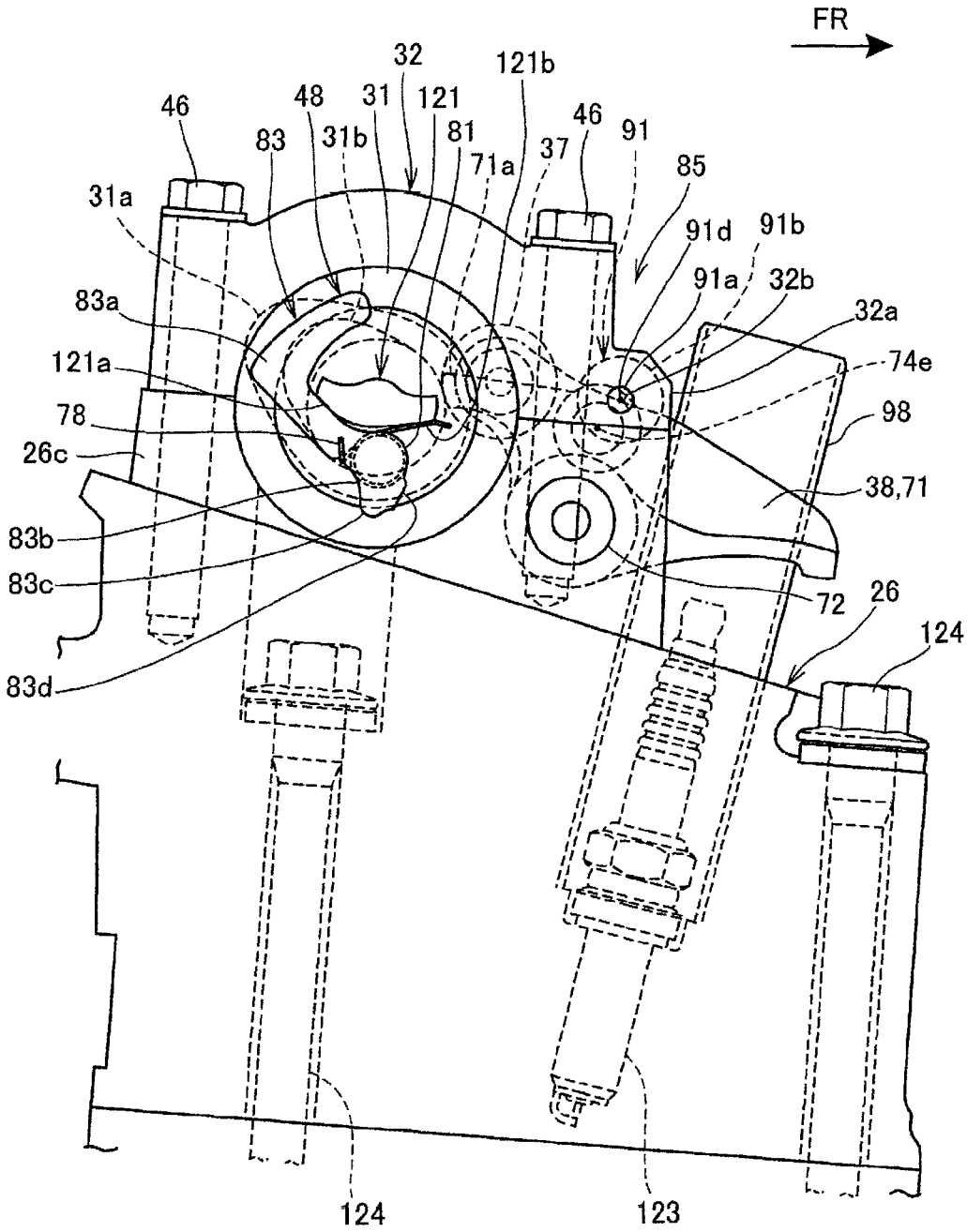
FIG. 6 is a side view of essential parts of the exhaust-side stopping mechanism and a decompression mechanism.

FIG. 6 is a side view of essential parts of the exhaust-side stopping mechanism 85 and the decompression mechanism 48.

The pressing portion 91*b* of the pushrod 91 constituting the exhaust-side stopping mechanism 85 is formed larger in diameter than the rod portion 91*a* so that, even if the connecting pin 74 moves back and forth with the swing of the first rocker arm 38, the pressing portion 91*b* can be constantly brought into contact with the end surface of the connecting pin 74 to press it.

The rod insertion hole 32*b* for insertion of the rod portion 91*a* is provided in the holder protruding portion 32*a* of the camshaft holder 32. The rod portion 91*a*, in side view, is disposed between the bolt 46 and the cap guiding member 98. Furthermore, the axis 74*e* (the portion indicated by a black circle) of the connecting pin 74 is situated below the axis 91*d* (the portion indicated by a black circle) of the pushrod 91. Therefore, the pushrod 91 is disposed in an upper portion of the space between the bolt 46 and the cap guiding member 98 which gradually increases toward the upper side, thereby allowing greater flexibility in the layout of the pushrod 91.

The decompression mechanism 48 includes a weight stopper 121 that is provided at an end of the camshaft 31 for restraining the weight 83 from turning around the shaft 81.

The weight 83 is composed of a weight body 83*a* that is in L-shape in a side view, and a projection 83*c* that protrudes from one end 83*b* of the weight body 83*a* for abutment against the weight stopper 121. The one end 83*b* is mounted to the shaft 81.

At the time of low-speed rotation of the camshaft 31 (including at the time of internal combustion engine starting), as shown in the drawings, the weight body 83*a* is brought into abutment against a first stopper 121*a* formed on the weight stopper 121 by the elastic force of the torsion coil spring 78, thereby restraining the weight 83 from turning in one direction (clockwise in the drawings). On the other hand, at the time of high-speed rotation of the camshaft 31, the weight body 83*a* is turned in the other direction (counterclockwise in the drawing) by centrifugal force, against the elastic force of the torsion coil spring 78. Then when the centrifugal force further increases, a side surface 83*d* of the projection 83*c* is brought into abutment against a second stopper 121*b* formed on the weight stopper 121, thereby restraining the weight 83 from turning in the other direction. A spark plug 123 is inserted into the cap guiding member 98 and mounted to the cylinder head body 26 with a bolt 124 for fastening the cylinder head 21 to the crankcase 11 (see FIG. 1) together with the cylinder block 16.

Referring back to FIG. 3, in the internal combustion engine of the first embodiment, (1) the first rocker arm 38 with the roller 37 serves as a drive-side rocker arm that is constantly driven by the camshaft 31, and the second rocker arm 71 serves as an inactive rocker arm that can be stopped; (2) the first rocker arm 38 is disposed close to the solenoid actuator 87 and the second rocker arm 71 is disposed away from the solenoid actuator 87; (3) when the solenoid actuator 87 is off, the connecting pin 74 is inserted into the first rocker arm 38; and (4) the decompression mechanism 48 is adjacent to the exhaust cam 31*b* that slides with the first rocker arm 38.

Next, the operation of the above-described exhaust-side stopping mechanism 85 will be described.

Figure 7:
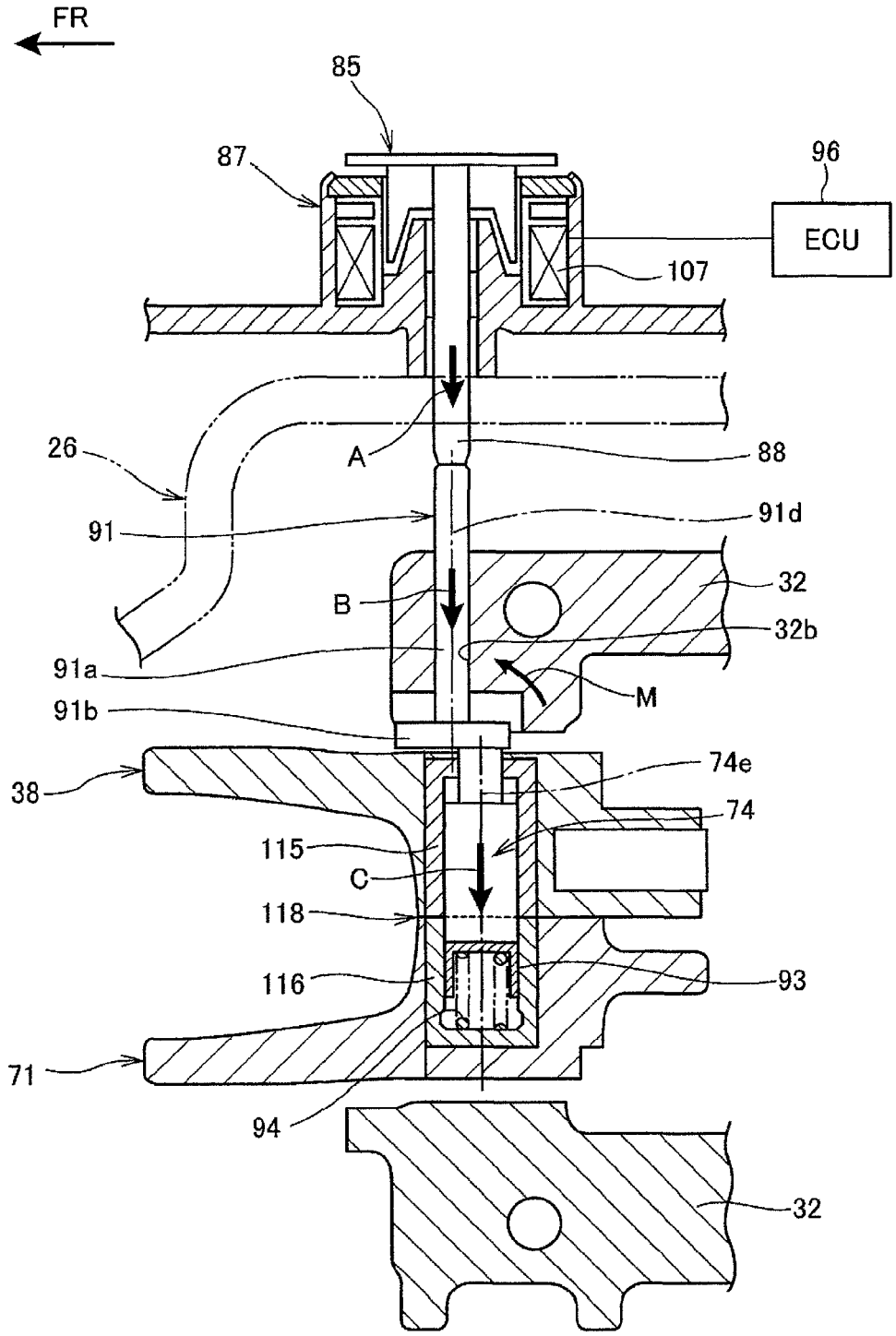
FIG. 7 is an operational diagram illustrating operation of the exhaust-side stopping mechanism.

FIG. 7 is an operational diagram illustrating the operation of the exhaust-side stopping mechanism 85.

For example, as shown in FIG. 5, when the internal combustion engine is in a low-load region, the ECU 96 turns off the solenoid actuator 87 to allow the connecting pin 74 to be housed within the first rocker arm 38, thereby separating the second rocker arm 71 from the first rocker arm 38. Thus, the first rocker arm 38 swings with rotation of the camshaft 31, while the second rocker arm 71 becomes inactive because the second rocker arm 71 is disconnected from the first rocker arm 38, so that one of the exhaust valves 39 is shifted to its closed position.

On the other hand, as shown in FIG. 7, when the internal combustion engine is in a high-load region, the ECU 96 turns on the solenoid actuator 87 to energize the coil 107, thereby moving the plunger 88 inwardly of the cylinder head 21 as shown by arrow A. In response to this, the pushrod 91 moves as shown by arrow B toward the first rocker arm 38, and then as shown by arrow C, the connecting pin 74 goes through the mating face 118 between the first rocker arm 38 and the second rocker arm 71 into the cylinder body 116 of the second rocker arm 71. Thus, the first rocker arm 38 and the second rocker arm 71 are connected to each other and integrally swung to open and close the two exhaust valves 39 (see FIG. 2). At this time, the axial compression force generated by the pressing force of the solenoid actuator 87 and the elastic force of the compression coil spring 94 acts on the pushrod 91 and the connecting pin 74. Therefore, a moment M indicated by an arrow is produced on a connecting portion between the rod portion 91*a* and the pressing portion 91*b* of the pushrod 91 by an eccentricity between the axis 91*d* and the axis 74*e*.

Further, when the internal combustion engine shifts from the high-load region to the low-load region, the ECU 96 turns off the solenoid actuator 87 again to move the plunger 88 back. Consequently, the connecting pin 74 and the pushrod 91 are returned toward the plunger 88 by the elastic force of the compression coil spring 94 in the first rocker arm 38. At this time, since the pushrod 91 is returned from a position with the rod portion 91*a* of the pushrod 91 against the rod insertion hole 32*b* under the influence of the above-described moment M (that is, in the state wherein a frictional force is generated), the initial movement of the pushrod 91 becomes slow, so that a quick return of the pushrod 91 can be prevented. Thus, it is possible to reduce the generation of a knocking sound due to an abutting contact between the end of the pushrod 91 and the plunger 88 or between the connecting pin 74 and the pushrod 91.

Next, the operation of the decompression mechanism 48 will be described.

Figure 8A:
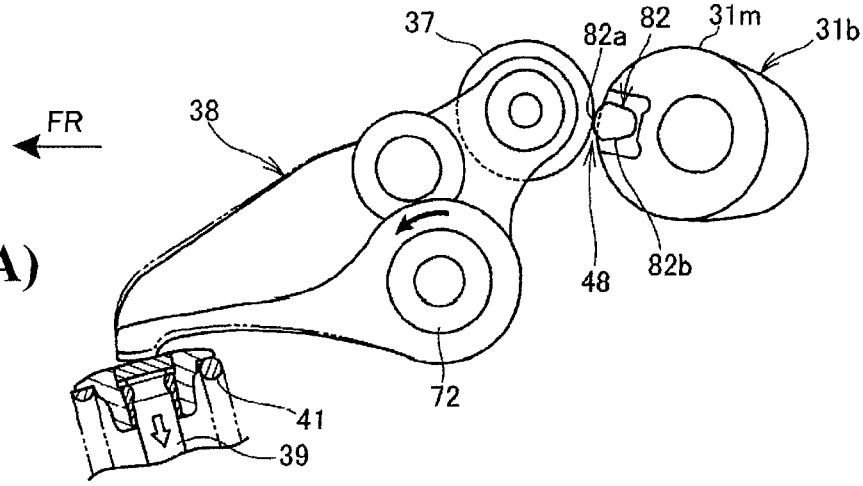
FIGS. 8(A) to 8(C) are operational diagrams illustrating the operation of the decompression mechanism.
Figure 8B:
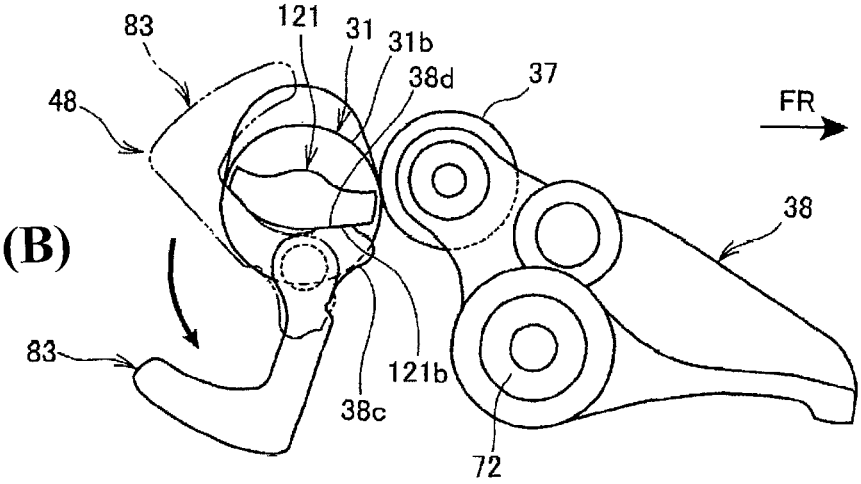
Figure 8C:
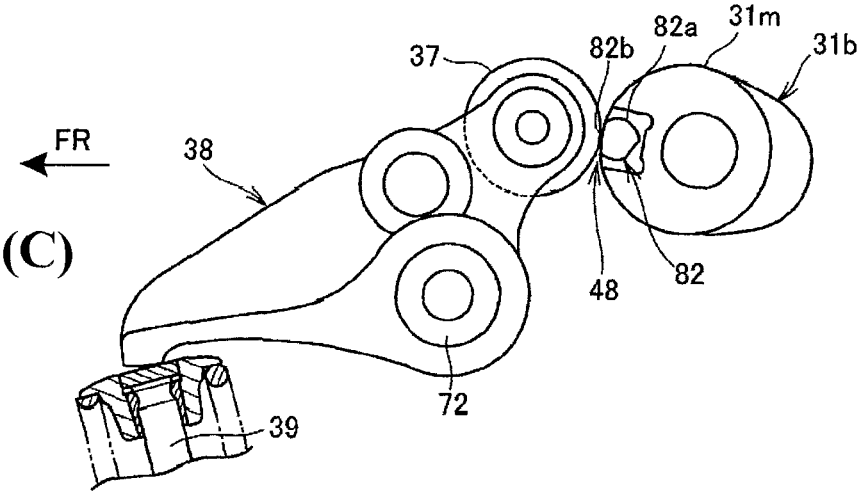

FIGS. 8(A) to 8(C) are operational diagrams illustrating the operation of the decompression mechanism 48, wherein FIG. 8(A) is an operational diagram showing the actuation of the decompression mechanism 48; FIG. 8(B) is an operational diagram showing the operation of the weight 83 of the decompression mechanism 48 and FIG. 8(C) is an operational diagram showing the operation of de-actuation of the decompression mechanism 48.

Referring to FIG. 8(A), when the camshaft 31 rotates at low speed during an internal combustion engine starting (upon cranking), as shown in FIG. 6, the centrifugal force acting on the weight 83 is small and therefore the weight 83 abuts against the first stopper 121*a* of the weight stopper 121 under the elastic force of the torsion coil spring 78. At this time, as shown in FIG. 8(A), the protrusion 82*a* included in the cam portion 82 of the decompression mechanism 48 protrudes radially outwardly from the base circle portion 31*m* of the exhaust cam 31*b*. Thus, when the protrusion 82*a* slides with the roller 37 of the first rocker arm 38, the first rocker arm 38 swings about the rocker shaft 72 in the direction indicated by an arrow to press the exhaust valve 39 in the direction indicated by a hollow arrow against the elastic force of the valve spring 41 to its open position. Consequently, the pressure in the combustion chamber (in particular, the pressure in the compression stroke) is reduced, thereby requiring less force for cranking and allowing an improvement in starting performance.

As shown in FIG. 8(B), when the internal combustion engine RPM increases and the camshaft 31 rotates at a high speed, the weight 83 turns in the direction indicated by an arrow from the position shown by a phantom line with a great centrifugal force acting on the weight 83 of the decompression mechanism 48. When the side surface 83*d* of the projection 83*c* of the weight 83 is brought into abutment against the second stopper 121*b* of the weight stopper 121, the turning of the weight 83 on the camshaft 31 stops. In this state, as shown in FIG. 8(C), the cam portion 82 of the decompression mechanism 48 is also stopped after its turning, and the arcuate portion 82*b* of the cam portion 82 forms a portion of the circle in cooperation with the base circle portion 31*m* of the exhaust cam 31*b*. Therefore, even if the arcuate portion 82*b* slides with the roller 37 of the first rocker arm 38, the first rocker arm 38 does not swing. Consequently, the decompression mechanism 48 is in an inactive state that exerts no influence upon the opening and closing of the exhaust valve 39.

Figure 9:
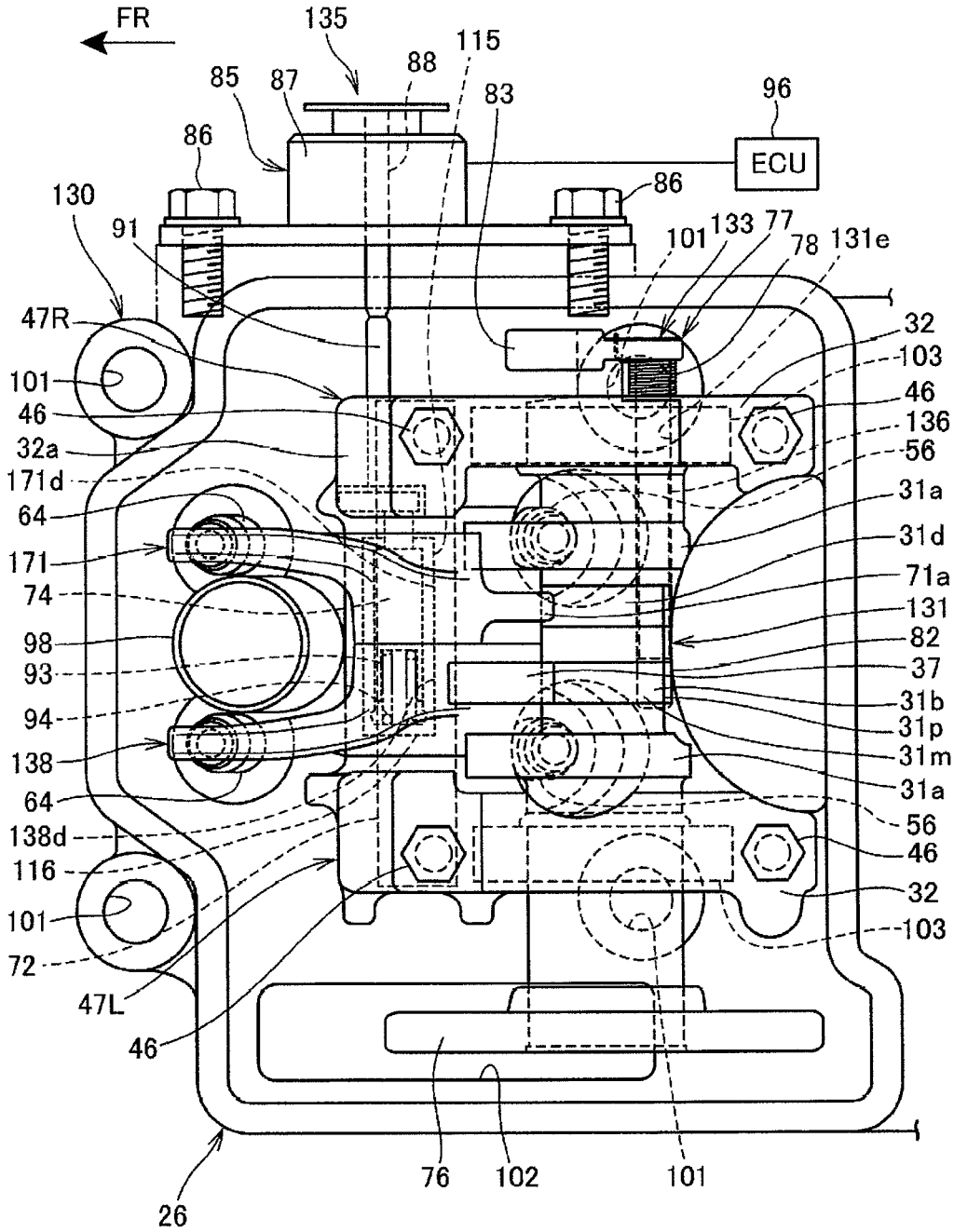
FIG. 9 is an explanatory diagram of a cylinder head (according to a second embodiment)

FIG. 9 is an explanatory diagram of a cylinder head 130 (according to a second embodiment), viewed in the axial direction of the bolts 46 in the same manner as FIG. 3. It is to be noted that the same elements as the first embodiment shown in FIG. 3 are denoted by the same reference signs, and the detailed description thereof will not be repeated.

The cylinder head 130 includes a variable valve gear 135 installed in the cylinder head body 26 and the head cover 22 (see FIG. 1). The variable valve gear 135 differs from the variable valve gear 30 shown in FIG. 3 with respect to a camshaft 131, a first rocker arm 138, a second rocker arm 171, and a decompression mechanism 133.

More specifically, in the second embodiment, (1) the first rocker arm 138 with the roller 37 serves as a drive-side rocker arm that is constantly driven by the camshaft 131. In addition, the second rocker arm 171 serves as an inactive rocker arm that can be stopped; (2) the first rocker arm 138 is disposed away from the solenoid actuator 87 and the second rocker arm 171 is disposed close to the solenoid actuator 87; (3) when the solenoid actuator 87 is off, the connecting pin 74 is inserted into the second rocker arm 171; and (4) the decompression mechanism 133 is adjacent to the exhaust cam 31*b* that slides with the first rocker arm 138.

The camshaft 131, between the pair of intake cams 31*a*, is formed with the exhaust cam 31*b* that slides with the roller 37 of the first rocker arm 138, and the base circle 31*d* that slides with the claw portion 71*a* of the second rocker arm 171. The cut-out portion 31*p* is provided in one circumferential portion of the base circle portion 31*m* of the exhaust cam 31*b*. In other words, in the camshaft 131, the positions of the exhaust cam 31*b* and the base circle 31*d* are reversed from those of the camshaft 31 (see FIG. 3).

The camshaft 131 is rotatably supported in the pair of camshaft supporting portions 47L and 47R. The camshaft 131 is mounted at one end thereof with the cam sprocket 76 around which a timing chain (not shown) is wrapped.

In an end portion of the camshaft 131, an axial hole 131*e* is formed along the axis of the camshaft 131. The decompression mechanism 133 is turnably provided in the axial hole 131*e*.

The first rocker arm 138 is provided at the position of the second rocker arm 71 shown in FIG. 3. The second rocker arm 171 is provided at the position of the first rocker arm 38 shown in FIG. 3. The first rocker arm 138 and the second rocker arm 171 are turnably supported by the rocker shaft 72 and each are configured to open and close the exhaust valve 39 (see FIG. 2).

The first rocker arm 138 has an arm hole portion 138*d* opened in a side surface thereof, and the cylinder body 116 of cylindrical shape is press-fitted in the arm hole portion 138*d*. The pressing piece 93 is movably inserted into the cylinder body 116. The compression coil spring 94 is provided between the pressing piece 93 and the cylinder body 116.

The second rocker arm 171 has an arm hole portion 171*d* opened in a side surface thereof. In addition, the cylinder body 115 of cylindrical shape is press-fitted in the arm hole portion 171*d*. The connecting pin 74 is movably inserted into the cylinder body 115.

The decompression mechanism 133 differs from the decompression mechanism 48 shown in FIG. 3 with respect to only a shaft 136. More specifically, the shaft 136 is longer than the shaft 81 (see FIG. 3) and extends from the weight 83 to the exhaust cam 31*b*. The cam portion 82 provided at a tip of the shaft 136 is exposed to the outside from the cut-out portion 31*p* of the base circle portion 31*m* of the exhaust cam 31*b*.

Figure 10:
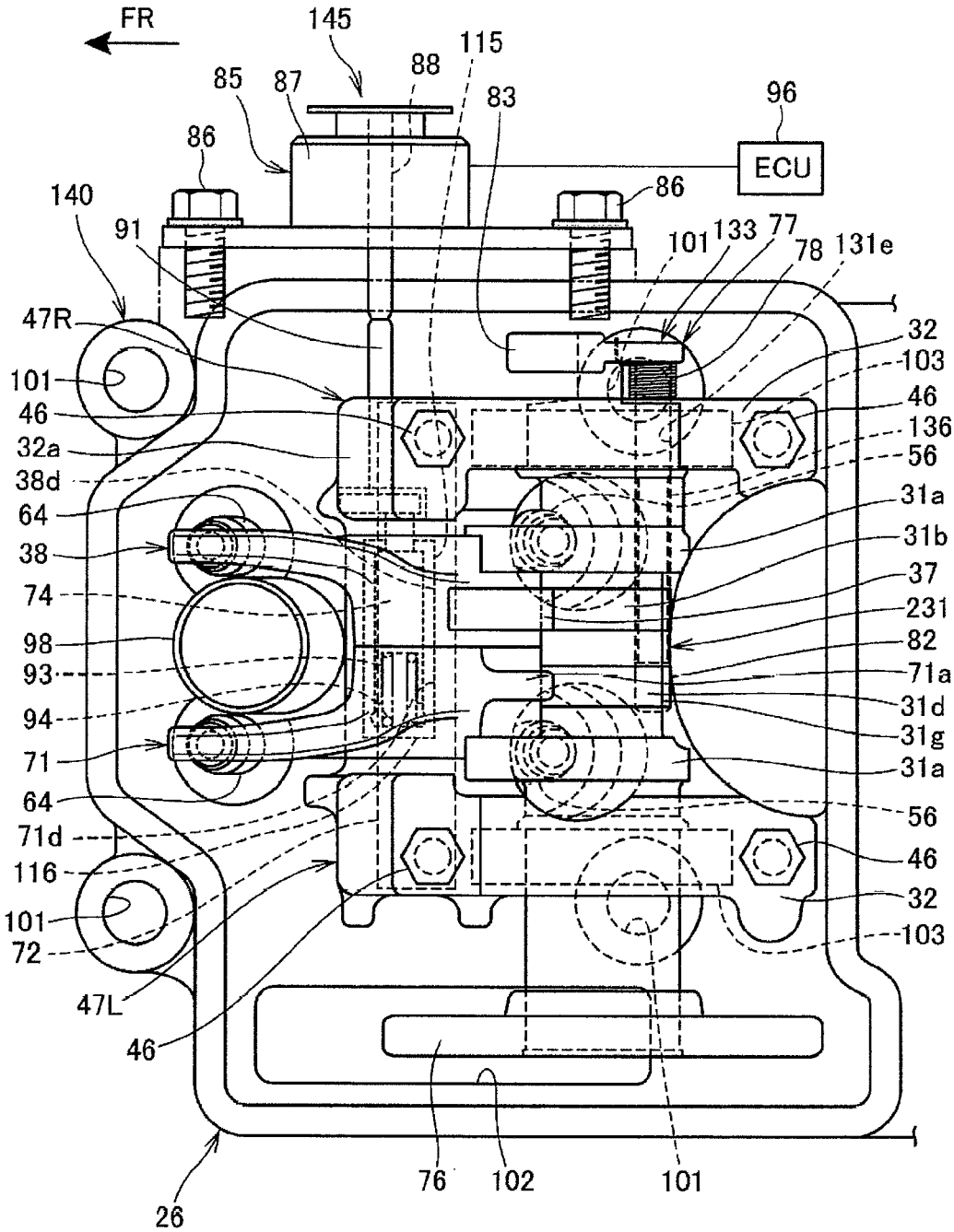
FIG. 10 is an explanatory diagram of a cylinder head (according to a third embodiment)

FIG. 10 is an explanatory diagram of a cylinder head 140 (according to a third embodiment), viewed in the axial direction of the bolts 46 in the same manner as FIG. 3. It is to be noted that the same elements as the first embodiment shown in FIG. 3 and the second embodiment shown in FIG. 9 are denoted by the same reference signs, and the detailed description thereof will not be repeated.

The cylinder head 140 includes a variable valve gear 145 assembled in the cylinder head body 26 and the head cover 22 (see FIG. 1). The variable valve gear 145 differs from the variable valve gear 30 shown in FIG. 3 with respect to a camshaft 231 and the decompression mechanism 133, and differs from the variable valve gear 135 shown in FIG. 9 with respect to the camshaft 231, the first rocker arm 38, and the second rocker arm 71.

More specifically, in the third embodiment, (1) the first rocker arm 38 with the roller 37 serves as a drive-side rocker arm that is constantly driven by the camshaft 231, and the second rocker arm 71 serves as an inactive rocker arm that can be stopped; (2) the first rocker arm 38 is disposed close to the solenoid actuator 87 and the second rocker arm 71 is disposed away from the solenoid actuator 87; (3) when the solenoid actuator 87 is off, the connecting pin 74 is inserted into the first rocker arm 38; and (4) the decompression mechanism 133 is adjacent to the base circle 31*d* that slides with the second rocker arm 71.

The camshaft 231, between the pair of intake cams 31*a*, is formed with the exhaust cam 31*b* that slides with the roller 37 of the first rocker arm 38, and the base circle 31*d* that slides with the claw portion 71*a* of the second rocker arm 71. A cut-out portion 31*g* is provided in one circumferential portion of the base circle 31*d*. In other words, in the camshaft 231, the positions of the exhaust cam 31*b* and the base circle 31*d* are reversed from those of the camshaft 131 (see FIG. 9).

The camshaft 231 is rotatably supported in the pair of camshaft supporting portions 47L and 47R. The camshaft 231 is mounted at one end thereof with the cam sprocket 76 around which a timing chain (not shown) is wrapped.

In an end portion of the camshaft 231, the axial hole 131*e* is formed along the axis of the camshaft 231. The decompression mechanism 133 is turnably provided in the axial hole 131*e*.

Next, the operation of the second rocker arm 71 and the decompression mechanism 133 will be described.

Figure 11A:
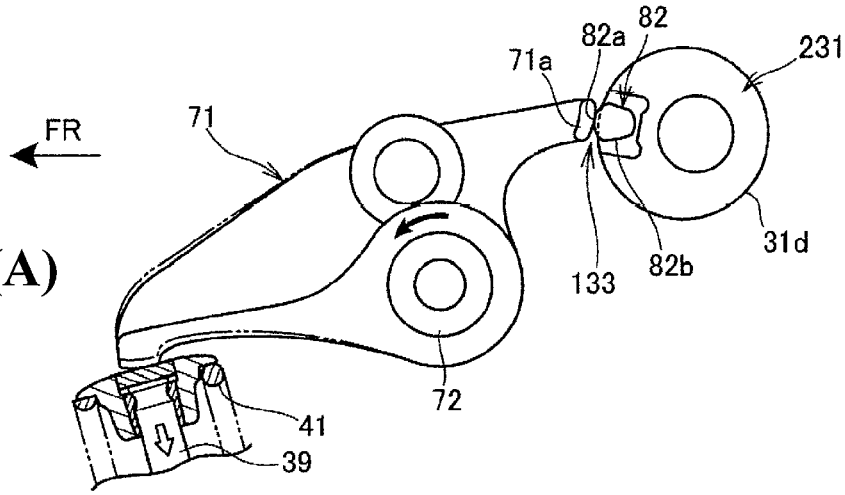
FIGS. 11(A) to 11(C) are operational diagrams illustrating the operation of a second rocker arm and a decompression mechanism.
Figure 11B:
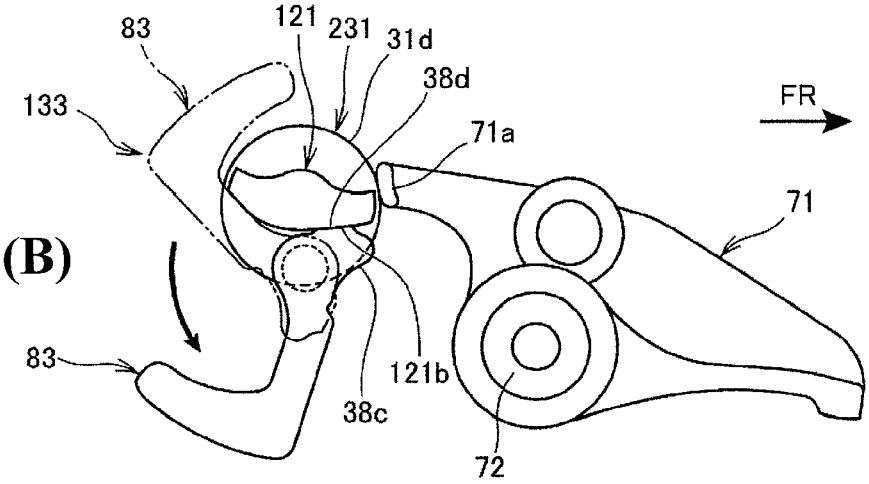
Figure 11C:
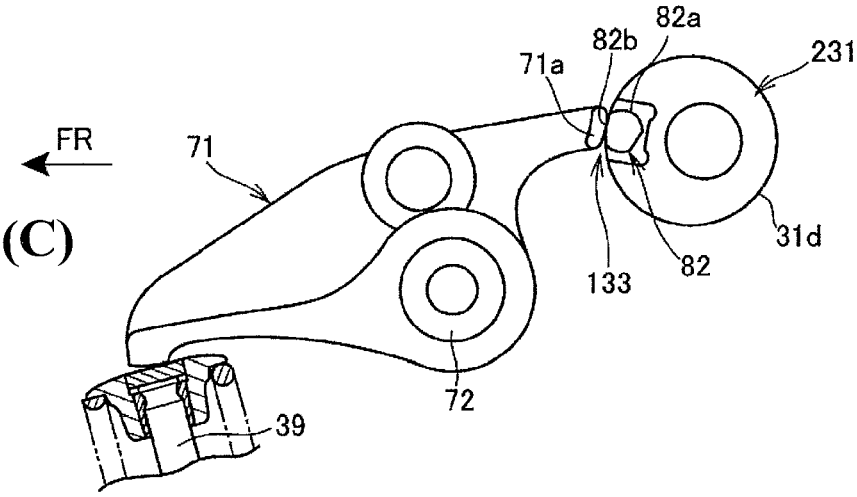

FIGS. 11(A) to 11(C) are operational diagrams illustrating the operation of the second rocker arm 71 and the decompression mechanism 133, wherein FIG. 11(A) is an operational diagram showing the actuation of the decompression mechanism 133; FIG. 11(B) is an operational diagram showing the operation of the weight 83 of the decompression mechanism 133; and FIG. 11(C) is an operational diagram showing the operation of de-actuation of the decompression mechanism 133.

Referring to FIG. 11(A), when the camshaft 231 rotates at a low speed during an internal combustion engine starting (upon cranking), as shown in FIG. 6, the centrifugal force acting on the weight 83 is small and therefore the weight 83 abuts against the first stopper 121*a* of the weight stopper 121 under the elastic force of the torsion coil spring 78. At this time, as shown in FIG. 11(A), the protrusion 82*a* included in the cam portion 82 of the decompression mechanism 133 protrudes radially outwardly from the base circle 31*d*. Thus, when the protrusion 82*a* slides with the claw portion 71*a* of the second rocker arm 71, the second rocker arm 71 swings about the rocker shaft 72 in the direction indicated by an arrow to press the exhaust valve 39 in the direction indicated by a hollow arrow against the elastic force of the valve spring 41 to its open position. Consequently, the pressure in the combustion chamber is reduced, thereby requiring less force for cranking and allowing an improvement in the starting performance.

As shown in FIG. 11(B), when the internal combustion engine RPM increases and the camshaft 231 rotates at a high speed, the weight 83 turns in the direction indicated by an arrow from the position shown by a phantom line with a great centrifugal force acting on the weight 83 of the decompression mechanism 133. When the side surface 83*d* of the projection 83*c* of the weight 83 is brought into abutment against the second stopper 121*b* of the weight stopper 121, the turning of the weight 83 stops. In this state, as shown in FIG. 11(C), the cam portion 82 of the decompression mechanism 133 is also stopped after its turning, and the arcuate portion 82*b* of the cam portion 82 forms a portion of the circle in cooperation with the base circle 31*d* of the camshaft 31. Therefore, even if the arcuate portion 82*b* slides with the claw portion 71*a* of the second rocker arm 71, the second rocker arm 71 does not swing. Consequently, the decompression mechanism 133 is in an inactive state that exerts no influence upon the opening and closing of the exhaust valve 39.

Figure 12:
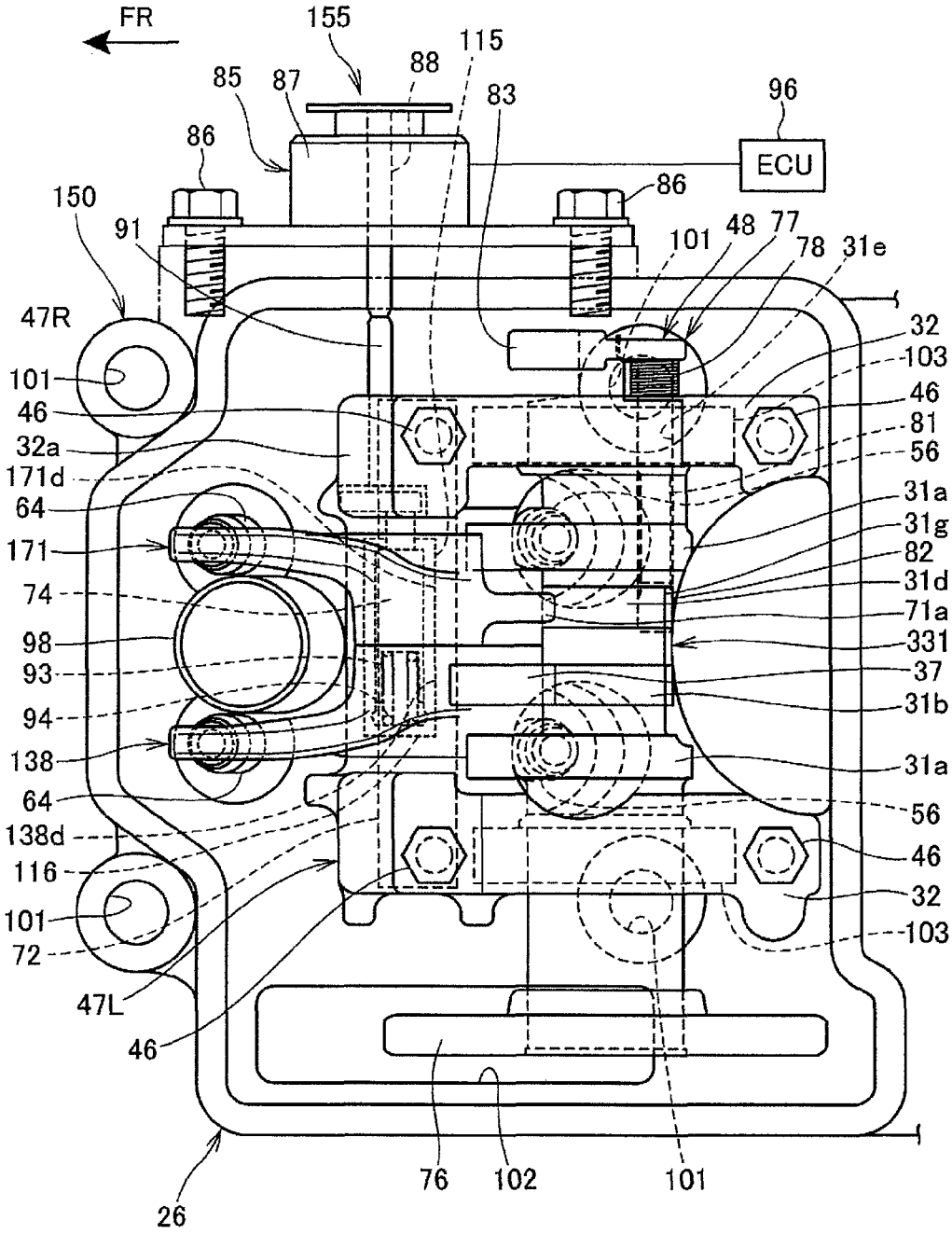
FIG. 12 is an explanatory diagram of a cylinder head (according to a fourth embodiment)

FIG. 12 is an explanatory diagram of a cylinder head 150 (according to a fourth embodiment), viewed in the axial direction of the bolts 46 in the same manner as FIG. 3. It is to be noted that the same elements as the first embodiment shown in FIG. 3, the second embodiment shown in FIG. 9, and the third embodiment shown in FIG. 10 are denoted by the same reference signs, and the detailed description thereof will not be repeated.

The cylinder head 150 includes a variable valve gear 155 assembled in the cylinder head body 26 and the head cover 22 (see FIG. 1). The variable valve gear 155 differs from the variable valve gear 30 shown in FIG. 3 with respect to a camshaft 331, the first rocker arm 138, and the second rocker arm 171. Also, the variable valve gear 155 differs from the variable valve gear 135 shown in FIG. 9 with respect to the camshaft 331, and the decompression mechanism 48. In addition, the variable valve gear 155 differs from the variable valve gear 145 shown in FIG. 10 with respect to the camshaft 331, the first rocker arm 138, the second rocker arm 171, and the decompression mechanism 48.

More specifically, in the fourth embodiment, (1) the first rocker arm 138 with the roller 37 serves as a drive-side rocker arm that is constantly driven by the camshaft 331, and the second rocker arm 171 serves as an inactive rocker arm that can be stopped; (2) the first rocker arm 138 is disposed away from the solenoid actuator 87 and the second rocker arm 171 is disposed close to the solenoid actuator 87; (3) when the solenoid actuator 87 is off, the connecting pin 74 is inserted into the second rocker arm 171 and (4) the decompression mechanism 48 is adjacent to the base circle 31*d* that slides with the second rocker arm 71.

The camshaft 331, between the pair of intake cams 31*a*, is formed with the exhaust cam 31*b* that slides with the roller 37 of the first rocker arm 138, and the base circle 31*d* that slides with the claw portion 71*a* of the second rocker arm 171. The cut-out portion 31*g* is provided in one circumferential portion of the base circle 31*d*. Also, in an end portion of the camshaft 331, the axial hole 31*e* is formed along the axis of the camshaft 331. The decompression mechanism 48 is turnably provided in the axial hole 31*e*.

The camshaft 331 is rotatably supported in the pair of camshaft supporting portions 47L and 47R. The camshaft 331 is mounted at one end thereof with the cam sprocket 76 around which a timing chain (not shown) is wrapped.

As shown in FIGS. 11 and 12 described above, the pair of exhaust rocker arms is composed of: the first rocker arm 138 serving as a drive-side rocker arm that is provided away from the pushrod 91 and constantly driven by the camshaft 331 during operation of the internal combustion engine 10 (see FIG. 1); and the second rocker arm 171 serving as an inactive rocker arm that is provided closer to the pushrod 91 than the first rocker arm 138 and becomes inactive when disconnected from the first rocker arm 138. The second rocker arm 171 is formed with the claw portion 71*a* that slides with the base circle 31*d* of the camshaft 331. The camshaft 331 is formed with the axial hole 31*e* serving as an axially extending hole that extends axially relative to the camshaft 331. The shaft 81 included in the decompression mechanism 48 is turnably inserted into the axial hole 31*e*. Also, the shaft 81 is provided at a tip thereof with the protrusion 82*a* that can protrude radially outwardly from the base circle 31*d*. Thus, with the structure in which the shaft 81 of the decompression mechanism 48 is turnably inserted into the axial hole 31*e* formed axially of the camshaft 331, it is possible to compactly dispose the decompression mechanism 48 and miniaturize the cylinder portion 12 (see FIG. 1). Thus, consequently, the internal combustion engine 10.

Figure 13:
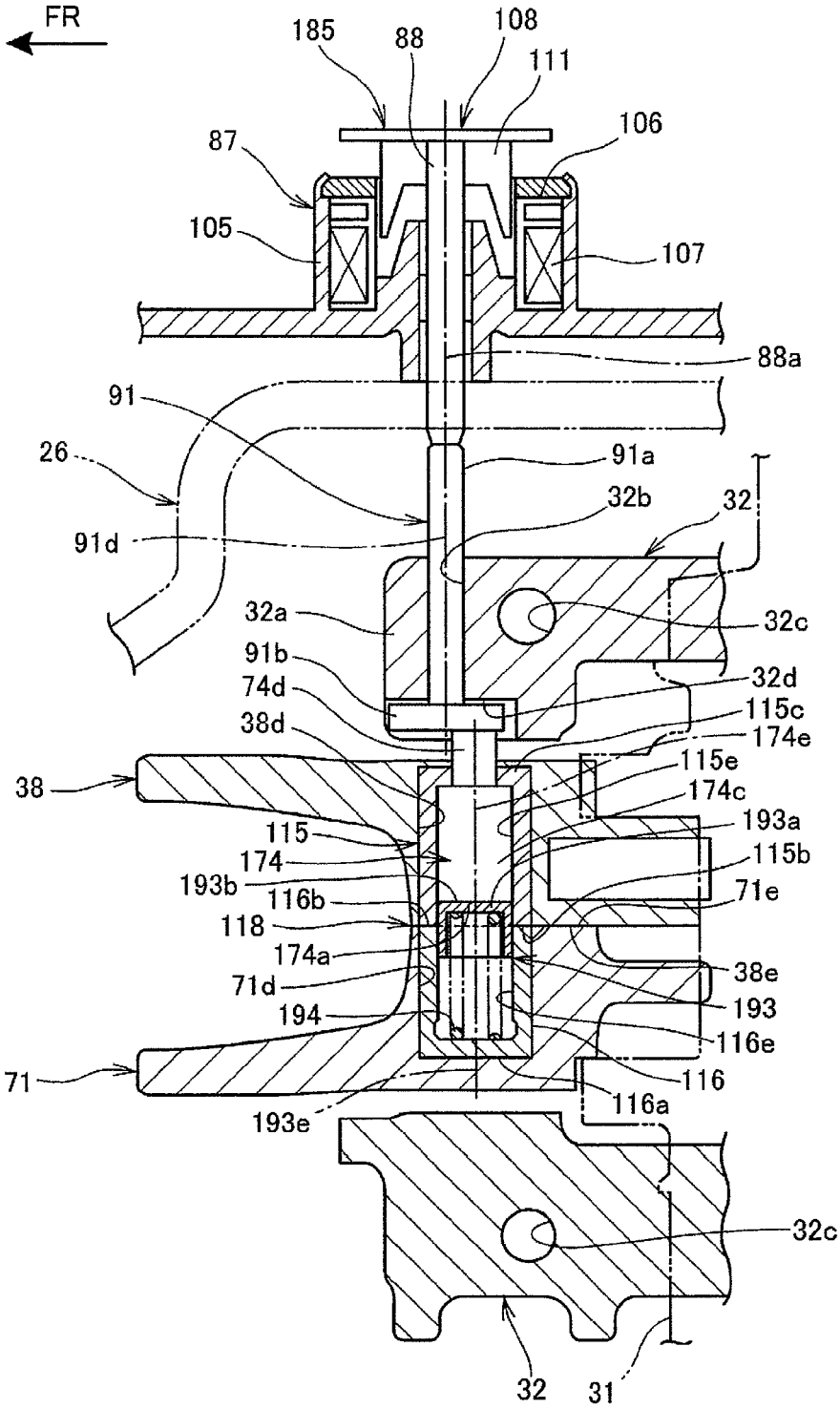
FIG. 13 is a sectional view of an exhaust-side stopping mechanism (according to a fifth embodiment)

FIG. 13 is a sectional view of an exhaust-side stopping mechanism 185 (according to a fifth embodiment).

The exhaust-side stopping mechanism 185 differs from the exhaust-side stopping mechanism 85 shown in FIG. 5 with respect to a pressure pin 174, a connecting pin 193, and a compression coil spring 194.

The fifth embodiment is the same as the first embodiment in that: (1) the first rocker arm 38 with the roller 37 serves as a drive-side rocker arm that is constantly driven by the camshaft 31, and the second rocker arm 71 serves as an inactive rocker arm that can be stopped; and (2) the first rocker arm 38 is disposed close to the solenoid actuator 87 and the second rocker arm 71 is disposed away from the solenoid actuator 87, and differs from the first embodiment with respect to (3) when the solenoid actuator 87 is off, the connecting pin 193 is inserted into the first rocker aim 38 and the second rocker arm 71 in a manner extending over both the rocker arms 38 and 71. It is to be noted that the decompression mechanism 48 may be adjacent to any of the exhaust cam 31*b* (see FIG. 3) that slides with the first rocker arm 38 and the base circle 31*d* (see FIG. 3) that slides with the second rocker arm 71.

The pressure pin 174 is composed of a large diameter portion 174*c* inserted into the cylinder body 115 and the small diameter portion 74*d* integrally formed at an end portion of the large diameter portion 174*c*. The small diameter portion 74*d* passes through the bottom wall 115*c* of the cylinder body 115 and extends toward the pushrod 91. An axis 174*e* of the pressure pin 174 and an axis 193*e* of the connecting pin 193 situated on the extended line of the axis 174*e* are offset toward the camshaft 31 with respect to the axis 91*d* of the pushrod 91.

The connecting pin 193 is a component with a U-shaped cross section that is movably inserted, adjacent to the pressure pin 174, into the pin holes 115*e* and 116*e* provided in the cylinder bodies 115 and 116, respectively.

The compression coil spring 194 has a mounting length greater than that of the compression coil spring 94 shown in FIG. 5 and is provided between a bottom wall 193*a* of the connecting pin 193 and the bottom wall 116*a* of the cylinder body 116. The compression coil spring 194 is in position to press, with its elastic force, an end surface 193*b* of the connecting pin 193 against a leading end surface 174*a* of the pressure pin 174.

Consequently, the pressing piece 93 is inserted into the cylinder bodies 115 and 116 in a manner extending over both the cylinder bodies 115 and 116, so that the first rocker arm 38 and the second rocker arm 71 are integrally connected to each other. Thus, while the first rocker arm 38 swings with rotation of the camshaft 31, the second rocker arm 71 also swings, thereby opening and closing the two exhaust valves (see FIG. 2).

Next, the operation of the above-described exhaust-side stopping mechanism 185 will be described.

Figure 14:
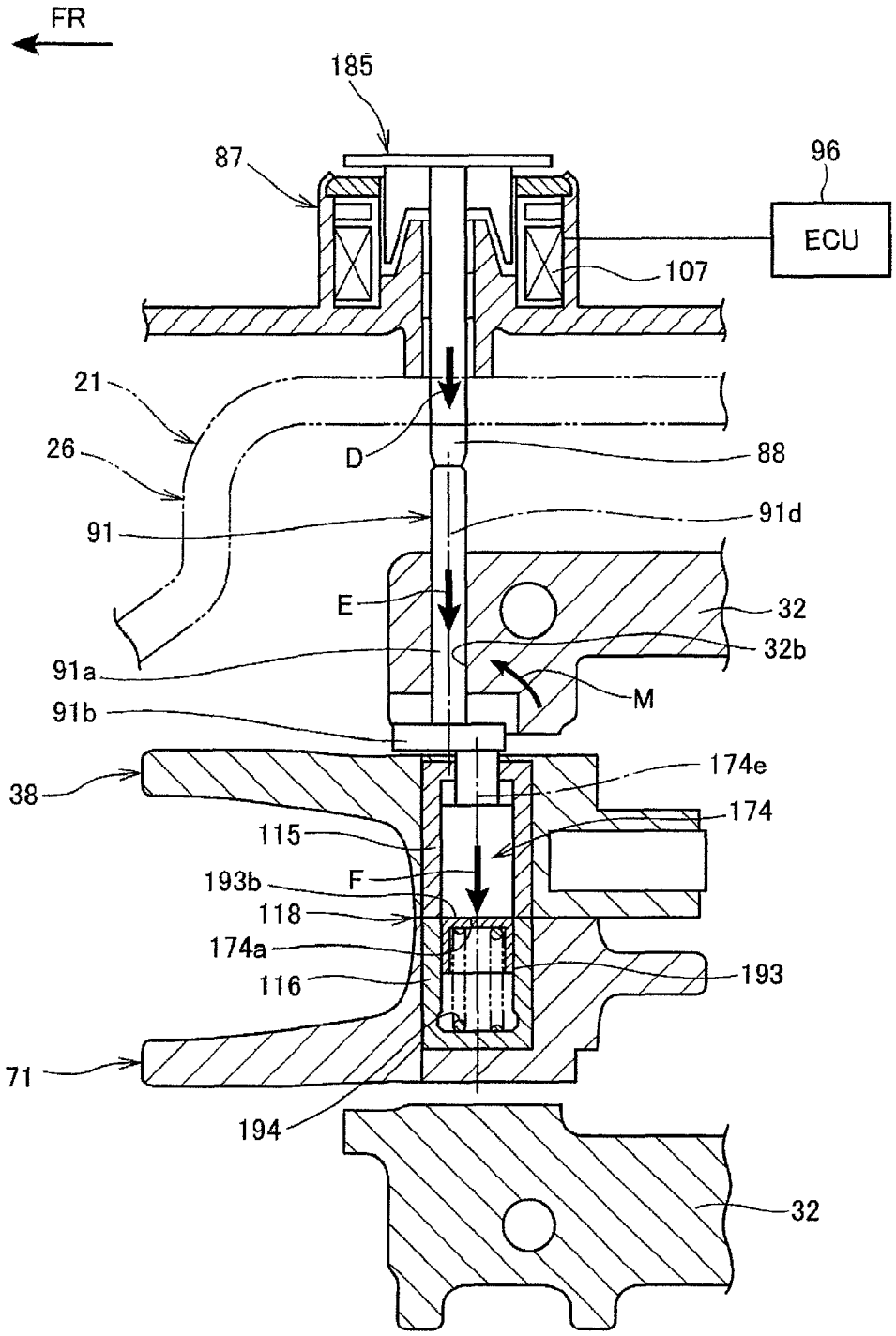
FIG. 14 is an operational diagram illustrating operation of the exhaust-side stopping mechanism.

FIG. 14 is an operational diagram illustrating the operation of the exhaust-side stopping mechanism 185.

For example, as shown in FIG. 13, when the internal combustion engine is in a high-load region, the ECU 96 turns off the solenoid actuator 87 to allow the connecting pin 193 to be housed within both the first rocker arm 38 and the second rocker arm 71, thereby interlocking the second rocker arm 71 with the first rocker arm 38 for opening and closing of both exhaust valves 39.

On the other hand, as shown in FIG. 14, when the internal combustion engine is in a low-load region, the ECU 96 turns on the solenoid actuator 87 to energize the coil 107, thereby moving the plunger 88 inwardly of the cylinder head 21 as shown by arrow D. In response to this, the pushrod 91 moves as shown by arrow E toward the first rocker arm 38, and then as shown by arrow F, the pressure pin 174 moves toward the second rocker arm 71, so that the leading end surface 174*a* of the pressure pin 174 and the end surface 193*b* of the connecting pin 193 are flush with the mating face 118 between the first rocker aim 38 and the second rocker arm 71. Consequently, the connection between the first rocker arm 38 and the second rocker arm 71 through the connecting pin 193 is released. Thus, the first rocker arm 38 keeps swinging, while the second rocker arm 71 stops swinging. In addition, the exhaust valve 39 (see FIG. 2) driven by the first rocker arm 38 can be opened and closed, while the exhaust valve 39 driven by the second rocker arm 71 is closed.

As shown in FIGS. 3 and 9 described above, the first and second embodiments are the same in that the decompression mechanism 48 or 133 is adjacent to the exhaust cam 31*b* that slides with the first rocker arm 38 or 138 with the roller which serves as a drive-side rocker aim. However, these embodiments are different in the positions of the first rocker arms 38 and 138 relative to the solenoid actuator 87.

Furthermore, as shown in FIGS. 10 and 12, the third and fourth embodiments are the same in that the decompression mechanism 133 or 48 is adjacent to the base circle 31*d* that slides with the second rocker arm 71 or 171 serving as an inactive rocker arm. However, these embodiments are different in the positions of the second rocker aims 71 and 171 relative to the solenoid actuator 87.

Moreover, as shown in FIGS. 3 and 13, the first and fifth embodiments are the same in that the first rocker arm 38 with the roller 37, serving as a drive-side rocker arm, is disposed close to the solenoid actuator 87 and the second rocker arm 71 serving as an inactive rocker arm is disposed away from the solenoid actuator 87. However, these embodiments are different in the positions of the connecting pins 74 and 193 when the solenoid actuator 87 is off. More specifically, the connecting pin 74 of the first embodiment is inserted into the first rocker arm 38, while the connecting pin 193 of the fifth embodiment is inserted into both the first rocker arm 38 and the second rocker arm 71.

As shown in FIGS. 2, 3, and 5 described above, in the variable valve gear 30 for the internal combustion engine 10, the camshaft 31 is rotatably supported by the supporting walls 26*c* serving as a pair of cam supporting portions provided in the cylinder head 21, and the pair of camshaft holders 32 formed separately from the supporting walls 26*c*. The first rocker arm 38 and the second rocker aim 71 serving as two exhaust rocker arms driven by the camshaft 31 are swingably supported by the rocker shaft 72 mounted in the pair of supporting walls 26*c*, and disposed adjacent to each other. The connecting pin 74 is movably inserted into the pin holes 115*e* and 116*e* provided in the first rocker arm 38 and the second rocker arm 71 by the solenoid actuator 87, serving as an actuator, through the pushrod 91, thereby connecting or disconnecting the first rocker arm 38 and the second rocker arm 71 to or from each other. In the variable valve gear 30 for the internal combustion engine 10, the pushrod 91 is slidably supported in the rod insertion hole 32*b* serving as a through-hole provided in the camshaft holder 32. The connecting pin 74 is disposed between the pair of camshaft holders 32. The axis 74*e* of the connecting pin 74 is offset toward the camshaft 31 with respect to the axis 91*d* of the pushrod 91.

With this construction, the connecting pin 74 and the pushrod 91 can be disposed in a concentrated manner close to the camshaft 31, and thus the variable valve gear 30 can be disposed in a small compact manner. Furthermore, the axis 74*e* of the connecting pin 74 is offset from the axis 91*d* of the pushrod 91. Thus, with the connecting pin 74 axially pressed by the solenoid actuator 87 through the pushrod 91, a moment can be produced on the pushrod 91. This moment can prevent the quick return of the pushrod 91 when the connection between the first rocker arm 38 and the second rocker arm 71 is released and reduce the generation of knocking sounds.

Furthermore, the connecting pin 74 is disposed close to the rocker shaft 72 that swingably supports the first rocker arm 38 and the second rocker arm 71. Thus, the deviations in a turning direction between the pin holes 115*e* and 116*e* of the first rocker arm 38 and the second rocker arm 71 and in a direction perpendicular to the axis between the connecting pin 74 and the pushrod 91 can be further reduced, thereby allowing easy insertion of the connecting pin 74 into the pin hole 116*e* and a reduction of the wearing of the sliding portion between the connecting pin 74 and the pushrod 91.

Also, as shown in FIGS. 2, 3, 4, and 6, the first rocker arm 38 and the second rocker arm 71 taken as a pair are disposed one on each side of the spark plug 123. The support boss 26*e* formed integral with the cylinder head body 26 is disposed below between the first rocker arm 38 and the second rocker arm 71 for supporting the rocker shaft 72. The connecting pin 74 is disposed above the support boss 26*e*. Thus, the rocker shaft 72 is supported by the support boss 26*e* in addition to the pair of supporting walls 26*c*. Therefore, the stiffness of the rocker shaft 72 can be ensured. Also, the support boss 26*e* is disposed by effectively using the space between the pair of supporting walls 26*c*. Therefore, the variable valve gear 30 can be made compact.

Furthermore, as shown in FIGS. 5 and 6, the pushrod 91 is composed of the rod portion 91*a* and the pressing portion 91*b* having a diameter larger than the rod portion 91*a*. The pressing portion 91*b* is provided at an end of the rod portion 91*a* for abutment against an end surface of the connecting pin 74. The rod portion 91*a* is inserted into the rod insertion hole 32*b* provided toward the spark plug 123 with respect to the bolts 46 that fasten the camshaft holder 32 to the supporting walls 26*c*. Thus, it is possible to compactly dispose the variable valve gear 30 while avoiding the bolts 46 that fasten the supporting walls 26 and the camshaft holder 32 together.

Moreover, the camshaft holder 32 is formed with the holder protruding portion 32*a* that protrudes toward the spark plug 123. The holder protruding portion 32*a* is formed with the rod insertion hole 32*b*. Thus, it is possible to support the pushrod 91 while reducing the whole size of the camshaft holder 32 for reductions in size and weight.

In addition, as shown in FIGS. 5 and 8(A) to 8(C), the pair of exhaust rocker arms is composed of the first rocker arm 38 serving as a drive-side rocker arm that is provided close to the pushrod (91) and constantly driven by the camshaft (31) during operation of the internal combustion engine 10 (see FIG. 1) and the second rocker arm 71 serving as an inactive rocker arm that is provided on the side of the first rocker arm 38 opposite the pushrod 91 and becomes inactive when disconnected from the first rocker arm 38. The camshaft 31 is formed with the exhaust cam 31*b* for driving the first rocker arm 38, and the axial hole 31*e* serving as an axially extending hole that extends axially of the camshaft 31. The shaft 81 included in the decompression mechanism 48 is inserted into the axial hole 31*e*. The shaft 81 is provided at a tip thereof with the protrusion 82*a* that can protrude radially outwardly from the base circle portion 31*m* provided on the exhaust cam 31*b*. Thus, with the structure in which the shaft 81 of the decompression mechanism 48 is turnably inserted into the axial hole 31*e* formed axially of the camshaft 31, it is possible to compactly dispose the decompression mechanism 48 and miniaturize the internal combustion engine 10.

In addition, as shown in FIGS. 2 and 3, the intake valve 34 is opened and closed by the camshaft 31 through the valve lifter 33, and the exhaust valve 39 is opened and closed by the camshaft 31 through the first rocker arm 38 and the second rocker arm 71. With this structure in which the intake and exhaust valves 34 and 39 are opened and closed by the single camshaft 31, the cylinder head 21 can be reduced in weight and size, as compared with a structure in which intake and exhaust valves are opened and closed by two respective camshafts.

In addition, as shown in FIG. 3, the bolts 46 are disposed two at each end of the camshaft 31. The connecting pin 74 is disposed between the pair of bolts 46 (that is, the pair of bolts 46 disposed on each side of the first rocker arm 38 and the second rocker arm 71 forwardly of the camshaft 31). Further, the connecting pin 74 is disposed between the camshaft 31 and the spark plug 123 (see FIG. 6) (or the cap guiding member 98). Thus, the connecting pin 74, and consequently, the variable valve gear 30, can be disposed in a small compact manner.

It should be understood that the above-described embodiments are given to illustrate an aspect of the present invention, and various modifications and applications may be arbitrarily made without departing from the spirit of the invention.

For example, in the foregoing embodiments, as shown in FIG. 3, the connecting pin 74 is moved by the solenoid actuator 87. However, the invention is not limited thereto, the connecting pin 74 may be moved by other types of actuators.

Furthermore, as shown in FIG. 6, the weight body 83*a* of the decompression mechanism 48 is in L-shape. However, the invention is not limited thereto, the weight body 83*a* may have other shapes such as a straight shape, an arcuate shape, and a C-shape. In short, any shape is applicable, which allows the weight body 83*a* to turn about the shaft 81 (see FIG. 3) with a centrifugal force.

Moreover, as shown in FIGS. 3, 9, 10, 12, and 13, the first rocker arm 38 or 138 and the second rocker arm 71 or 171 are provided with the cylinder bodies 115 and 116, respectively. The cylinder bodies 115 and 116 are provided with the pin holes 115*e* and 116*e*, respectively. However, the invention is not limited thereto, the pin holes 115*e* and 116*e* may be directly formed in the first rocker arm 38 or 138 and the second rocker arm 71 or 171, respectively, without the cylinder bodies 115 and 116.

In addition, the internal combustion engine 10 of the present invention can be also applied to motorcycles and various saddle-ride type vehicles in addition to the motorcycles. It should be noted that examples of the saddle-ride type vehicles include general vehicles in which a rider sits astride a vehicle body, and includes not only motorcycles (including motor-assisted bicycles), but also three-wheeled or four-wheeled vehicles classified as ATVs (All Terrain Vehicles).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable valve gear for an internal combustion engine wherein a camshaft is rotatably supported by a pair of cam supporting portions provided in a cylinder head and a pair of camshaft holders formed separately from the cam supporting portions; two exhaust rocker arms driven by the camshaft are swingably supported by a rocker shaft mounted in the pair of cam supporting portions, and disposed adjacent to each other; and a connecting pin is movably inserted into pin holes provided in the exhaust rocker arms by an actuator through a pushrod to connect or disconnect the two rocker arms to or from each other;

wherein the pushrod is slidably supported in a through-hole provided in the camshaft holder;

the connecting pin is disposed between the pair of camshaft holders; and the connecting pin includes an axis that is offset toward the camshaft with respect to an axis of the pushrod.

2. The variable valve gear for the internal combustion engine according to claim 1, wherein the connecting pin is disposed close to the rocker shaft that swingably supports the exhaust rocker arms.

3. The variable valve gear for the internal combustion engine according to claim 2, wherein the exhaust rocker arms taken as a pair are disposed one on each side of a spark plug;

a support boss formed integral with a cylinder head body is disposed below between the exhaust rocker arms for supporting the rocker shaft; and the connecting pin is disposed above the support boss.

4. The variable valve gear for the internal combustion engine according to claim 2, wherein the pushrod is composed of a rod portion and a pressing portion having a diameter larger than the rod portion, the pressing portion being provided at an end of the rod portion for abutment against an end surface of the connecting pin; and the rod portion is inserted into the through-hole provided toward the spark plug with respect to bolts that fasten the camshaft holder to the cam supporting portion.

5. The variable valve gear for the internal combustion engine according to claim 2, wherein the camshaft holder is formed with a protruding portion that protrudes toward the spark plug, the protruding portion being formed with the through-hole.

6. The variable valve gear for the internal combustion engine according to claim 2, wherein the pair of exhaust rocker arms is composed of a drive-side rocker arm that is provided close to the pushrod and constantly driven by the camshaft during operation of the internal combustion engine, and an inactive rocker arm that is provided on a side of the drive-side rocker arm opposite the pushrod and becomes inactive when disconnected from the drive-side rocker arm;

the camshaft is formed with an exhaust cam for driving the drive-side rocker arm and an axially extending hole that extends axially of the camshaft;

a shaft included in a decompression mechanism is turnably inserted into the axially extending hole; and the shaft is provided at a tip thereof with a protrusion that can protrude radially outwardly from a base circle portion provided on the exhaust cam.

7. The variable valve gear for the internal combustion engine according to claim 2, wherein the pair of exhaust rocker arms is composed of a drive-side rocker arm that is provided away from the pushrod and constantly driven by the camshaft during operation of the internal combustion engine, and an inactive rocker arm that is provided closer to the pushrod than the drive-side rocker arm and becomes inactive when disconnected from the drive-side rocker arm;

the inactive rocker arm is formed with a claw portion that slides with a base circle of the camshaft;

the camshaft is formed with an axially extending hole that extends axially of the camshaft;

the shaft included in the decompression mechanism is turnably inserted into the axially extending hole; and the shaft is provided at the tip thereof with the protrusion that can protrude radially outwardly from the base circle.

8. The variable valve gear for the internal combustion engine according to claim 2, wherein an intake valve is opened and closed by the camshaft through a valve lifter, and an exhaust valve is opened and closed by the camshaft through the exhaust rocker arms.

9. The variable valve gear for the internal combustion engine according to claim 1, wherein the exhaust rocker arms taken as a pair are disposed one on each side of a spark plug;

a support boss formed integral with a cylinder head body is disposed below between the exhaust rocker arms for supporting the rocker shaft; and the connecting pin is disposed above the support boss.

10. The variable valve gear for the internal combustion engine according to claim 9, wherein the pushrod is composed of a rod portion and a pressing portion having a diameter larger than the rod portion, the pressing portion being provided at an end of the rod portion for abutment against an end surface of the connecting pin; and the rod portion is inserted into the through-hole provided toward the spark plug with respect to bolts that fasten the camshaft holder to the cam supporting portion.

11. The variable valve gear for the internal combustion engine according to claim 9, wherein the bolts are disposed at each end of the camshaft; and the connecting pin is disposed between the pair of bolts, the connecting pin being disposed between the camshaft and the spark plug.

12. The variable valve gear for the internal combustion engine according to claim 1, wherein the pushrod is composed of a rod portion and a pressing portion having a diameter larger than the rod portion, the pressing portion being provided at an end of the rod portion for abutment against an end surface of the connecting pin; and the rod portion is inserted into the through-hole provided toward the spark plug with respect to bolts that fasten the camshaft holder to the cam supporting portion.

13. The variable valve gear for the internal combustion engine according to claim 12, wherein the bolts are disposed at each end of the camshaft; and the connecting pin is disposed between the pair of bolts, the connecting pin being disposed between the camshaft and the spark plug.

14. The variable valve gear for the internal combustion engine according to claim 1, wherein the camshaft holder is formed with a protruding portion that protrudes toward the spark plug, the protruding portion being formed with the through-hole.

15. The variable valve gear for the internal combustion engine according to claim 1, wherein the pair of exhaust rocker arms is composed of a drive-side rocker arm that is provided close to the pushrod and constantly driven by the camshaft during operation of the internal combustion engine, and an inactive rocker arm that is provided on a side of the drive-side rocker arm opposite the pushrod and becomes inactive when disconnected from the drive-side rocker arm;

the camshaft is formed with an exhaust cam for driving the drive-side rocker arm and an axially extending hole that extends axially of the camshaft;

a shaft included in a decompression mechanism is turnably inserted into the axially extending hole; and the shaft is provided at a tip thereof with a protrusion that can protrude radially outwardly from a base circle portion provided on the exhaust cam.

16. The variable valve gear for the internal combustion engine according to claim 1, wherein the pair of exhaust rocker arms is composed of a drive-side rocker arm that is provided away from the pushrod and constantly driven by the camshaft during operation of the internal combustion engine, and an inactive rocker arm that is provided closer to the pushrod than the drive-side rocker arm and becomes inactive when disconnected from the drive-side rocker arm;

the inactive rocker arm is formed with a claw portion that slides with a base circle of the camshaft;

the camshaft is formed with an axially extending hole that extends axially of the camshaft;

the shaft included in the decompression mechanism is turnably inserted into the axially extending hole; and the shaft is provided at the tip thereof with the protrusion that can protrude radially outwardly from the base circle.

17. The variable valve gear for the internal combustion engine according to claim 1, wherein an intake valve is opened and closed by the camshaft through a valve lifter, and an exhaust valve is opened and closed by the camshaft through the exhaust rocker arms.

18. A variable valve gear for an internal combustion engine comprising:

a camshaft rotatably supported by a pair of cam supporting portions provided in a cylinder head;

a pair of camshaft holders formed separately from the cam supporting portions;

two exhaust rocker arms driven by the camshaft and swingably supported by a rocker shaft mounted in the pair of cam supporting portions, and disposed adjacent to each other;

a connecting pin movably inserted into pin holes provided in the exhaust rocker arms by an actuator through a pushrod to connect or disconnect the two rocker arms to or from each other, said pushrod including an axis and being slidably supported in a through-hole provided in the camshaft holder with the connecting pin being disposed between the pair of camshaft holders; and an axis of the connecting pin being offset toward the camshaft with respect to the axis of the pushrod.

19. The variable valve gear for the internal combustion engine according to claim 18, wherein the connecting pin is disposed close to the rocker shaft that swingably supports the exhaust rocker arms.

20. The variable valve gear for the internal combustion engine according to claim 18, wherein the exhaust rocker arms taken as a pair are disposed one on each side of a spark plug;

a support boss formed integral with a cylinder head body is disposed below between the exhaust rocker arms for supporting the rocker shaft; and the connecting pin is disposed above the support boss.

* * * * *